US010403420B2

(12) United States Patent
Okada et al.

(10) Patent No.: US 10,403,420 B2
(45) Date of Patent: Sep. 3, 2019

(54) CHIP RESISTOR

(71) Applicant: ROHM CO., LTD., Kyoto (JP)

(72) Inventors: Hiroyuki Okada, Kyoto (JP); Yasuhiro Kondo, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 202 days.

(21) Appl. No.: 15/485,640

(22) Filed: Apr. 12, 2017

(65) Prior Publication Data

US 2017/0301436 A1 Oct. 19, 2017

(30) Foreign Application Priority Data

Apr. 18, 2016 (JP) ..... 2016-082979

(51) Int. Cl.

| | |
|---|---|
| ***H01C 1/16*** | (2006.01) |
| ***H01C 1/01*** | (2006.01) |
| ***H01C 1/14*** | (2006.01) |
| ***H01C 17/00*** | (2006.01) |

(52) U.S. Cl.

CPC ..... *H01C 1/16* (2013.01); *H01C 1/01* (2013.01); *H01C 1/14* (2013.01); *H01C 17/006* (2013.01)

(58) Field of Classification Search

CPC ..... H01C 1/16; H01C 1/01; H01C 1/14
USPC ..... 338/320
See application file for complete search history.

(56) References Cited

U.S. PATENT DOCUMENTS 4,654,628 A * 3/1987 Takayanagi ..... H01C 1/16 338/320
2004/0196138 A1* 10/2004 Thei ..... H01C 7/006 338/320
2015/0243412 A1* 8/2015 Kondo ..... H01C 1/012 361/287

FOREIGN PATENT DOCUMENTS

JP 2003-249403 A 9/2003

* cited by examiner

*Primary Examiner* — Kyung S Lee
*Assistant Examiner* — Iman Malakooti
(74) *Attorney, Agent, or Firm* — Rabin & Berdo, P.C.

(57) ABSTRACT

A chip resistor including, a substrate having a main surface, a first resistance circuit formed at the main surface of the substrate, a second resistance circuit formed at the main surface of the substrate apart from the first resistance circuit, a common internal electrode formed at the main surface of the substrate and electrically connected to the first resistance circuit and the second resistance circuit, a first internal electrode formed at the main surface of the substrate and electrically connected to the first resistance circuit, a second internal electrode formed at the main surface of the substrate and electrically connected to the second resistance circuit, and a dummy resistance circuit formed in a region between the first resistance circuit and the second resistance circuit at the main surface of the substrate so as to be in an electrically floating state.

12 Claims, 17 Drawing Sheets

CHIP RESISTOR

BACKGROUND OF THE INVENTION

1. Field of the Invention

The present invention relates to a chip resistor.

2. Description of the Related Art

Japanese patent application publication No. 2003-249403 discloses a chip resistor that includes a substrate, a resistor layer formed on the substrate, and a pair of terminal portions electrically connected to the resistor layer.

SUMMARY OF THE INVENTION

An embodiment according to the present invention provides a chip resistor including a substrate having a main surface, a first resistance circuit formed at the main surface of the substrate, a second resistance circuit formed at the main surface of the substrate apart from the first resistance circuit, a common internal electrode formed at the main surface of the substrate and electrically connected to the first resistance circuit and the second resistance circuit, a first internal electrode formed at the main surface of the substrate and electrically connected to the first resistance circuit, a second internal electrode formed at the main surface of the substrate and electrically connected to the second resistance circuit, and a dummy resistance circuit formed in a region between the first resistance circuit and the second resistance circuit at the main surface of the substrate so as to be in an electrically floating state.

The aforementioned as well as other objects, features, and effects will be made apparent by the following descriptions of embodiments referring to the accompanying drawings.

DETAILED DESCRIPTION OF THE PREFERRED EMBODIMENTS

Figure 1:
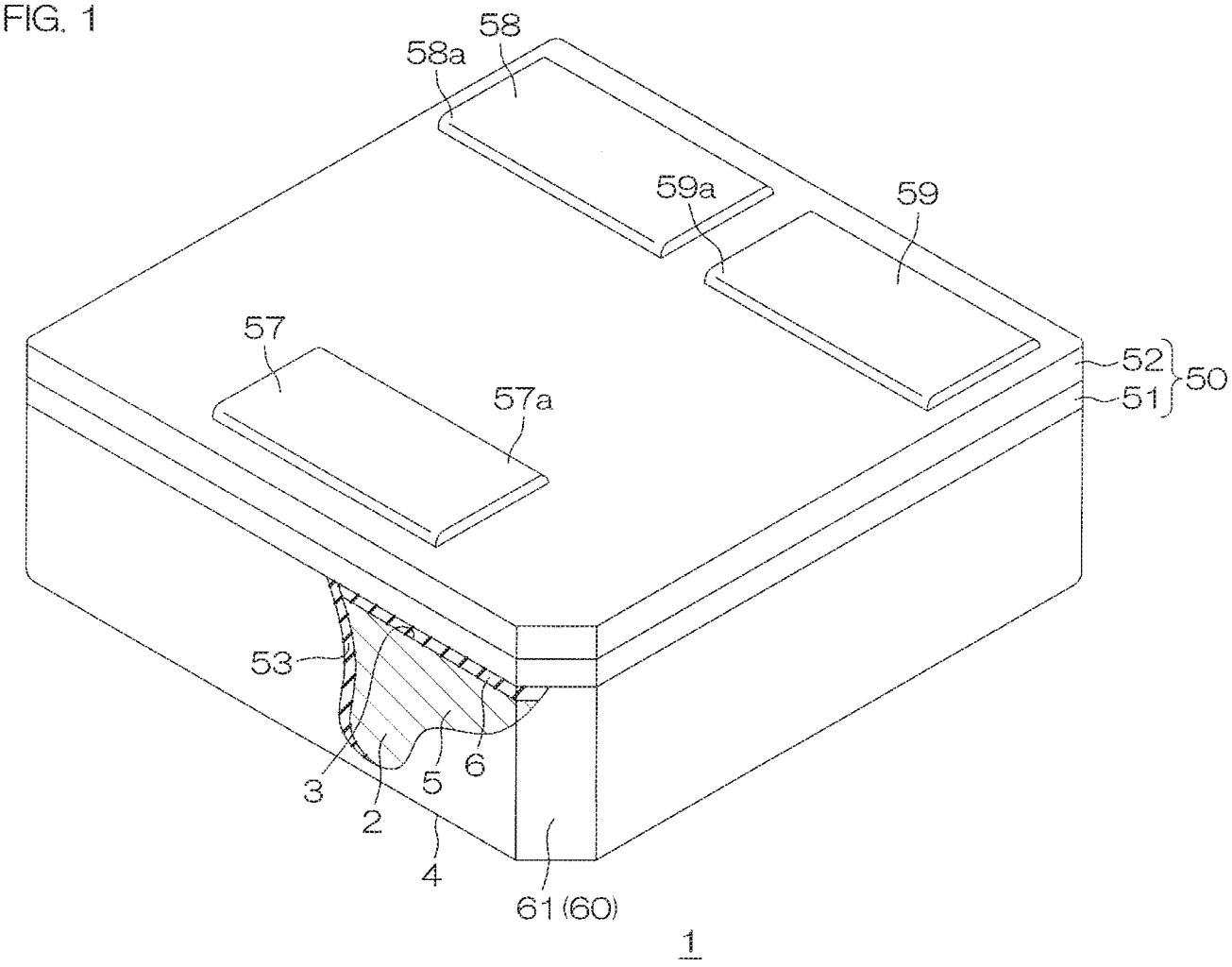
FIG. 1 is a partially cutaway perspective view of a chip resistor according to a first preferred embodiment of the present invention.

A case where a plurality of chip resistors having a substrate, and a resistance circuit formed on a surface of the substrate respectively is mounted onto a mounting board shall now be considered. In this case, the plurality of chip resistors is needed to be mounted onto the mounting board at a prescribed interval from each other for ensuring safety and insulation. According to this structure, an occupation area of the plurality of chip resistors with respect to the mounting board may be increased.

Inventors of the present application conduct research on a composite type chip resistor in which a plurality of resistance circuits is formed on the main surface of a single substrate. According to a chip resistor having such a structure, the plurality of resistance circuits can be formed on the main surface of the single substrate by a minute pattern corresponding to a layout of a mask used in a manufacturing process of the chip resistor. The chip resistor capable of shrinkage a reduction of the occupation area with respect to the mounting board can thus be provided.

However, one resistance circuit and the other resistance circuit arranged close to each other may electrically and/or magnetically affect each other in the chip resistor having the structure in which the plurality of resistance circuits is formed on the main surface of the single substrate. In a case where the electric and/or magnetic interaction takes place among the plurality of resistance circuits, resistance values of the plurality of resistance circuits may be fluctuated.

An embodiment according to the present invention provides a chip resistor capable of suppressing fluctuation in resistance values in a structure having a plurality of resistance circuits.

A chip resistor according to an embodiment of the present invention includes a substrate having a main surface, a first resistance circuit formed at the main surface of the substrate, a second resistance circuit formed at the main surface of the substrate apart from the first resistance circuit, a common internal electrode formed at the main surface of the substrate and electrically connected to the first resistance circuit and the second resistance circuit, a first internal electrode formed at the main surface of the substrate and electrically connected to the first resistance circuit, a second internal electrode formed at the main surface of the substrate and electrically connected to the second resistance circuit, and a dummy resistance circuit formed in a region between the first resistance circuit and the second resistance circuit at the main surface of the substrate so as to be in an electrically floating state.

According to the chip resistor, the dummy resistance circuit is formed in the region between the first resistance circuit and the second resistance circuit on the main surface of the substrate so as to be in the electrically floating state. A mutual electric effect and/or a mutual magnetic effect occurred between the first resistance circuit and the second resistance circuit can thus be absorbed by the dummy resistance circuit. A chip resistor capable of suppressing fluctuation in resistance values between the first resistance circuit and the second resistance circuit can thereby be provided.

Hereinafter, a plurality of embodiments according to the present invention will be described in detail with reference to the accompanying drawings.

Figure 2:
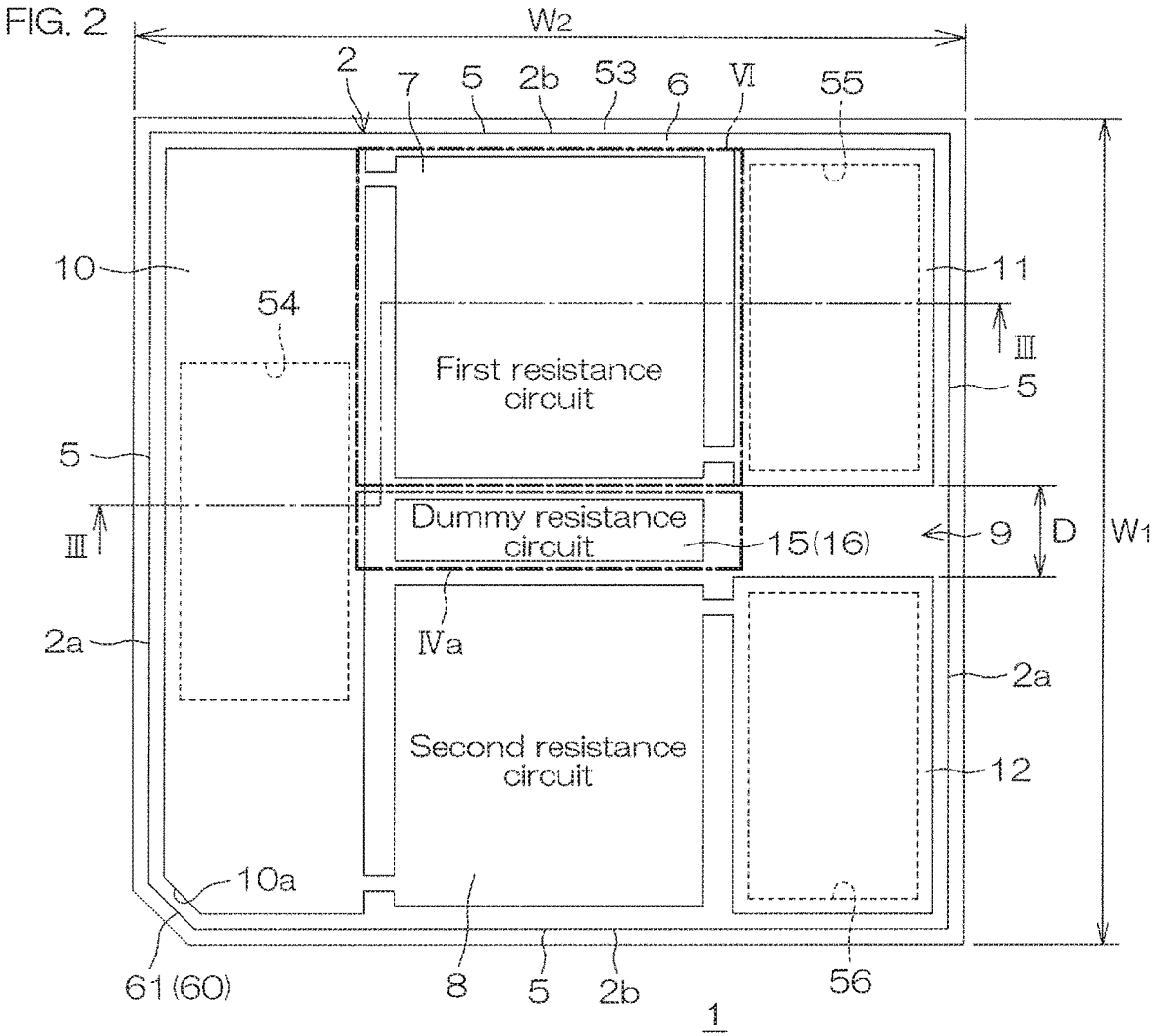
FIG. 2 is a plan view schematically illustrating an internal structure of the chip resistor shown in FIG. 1.
Figure 3:
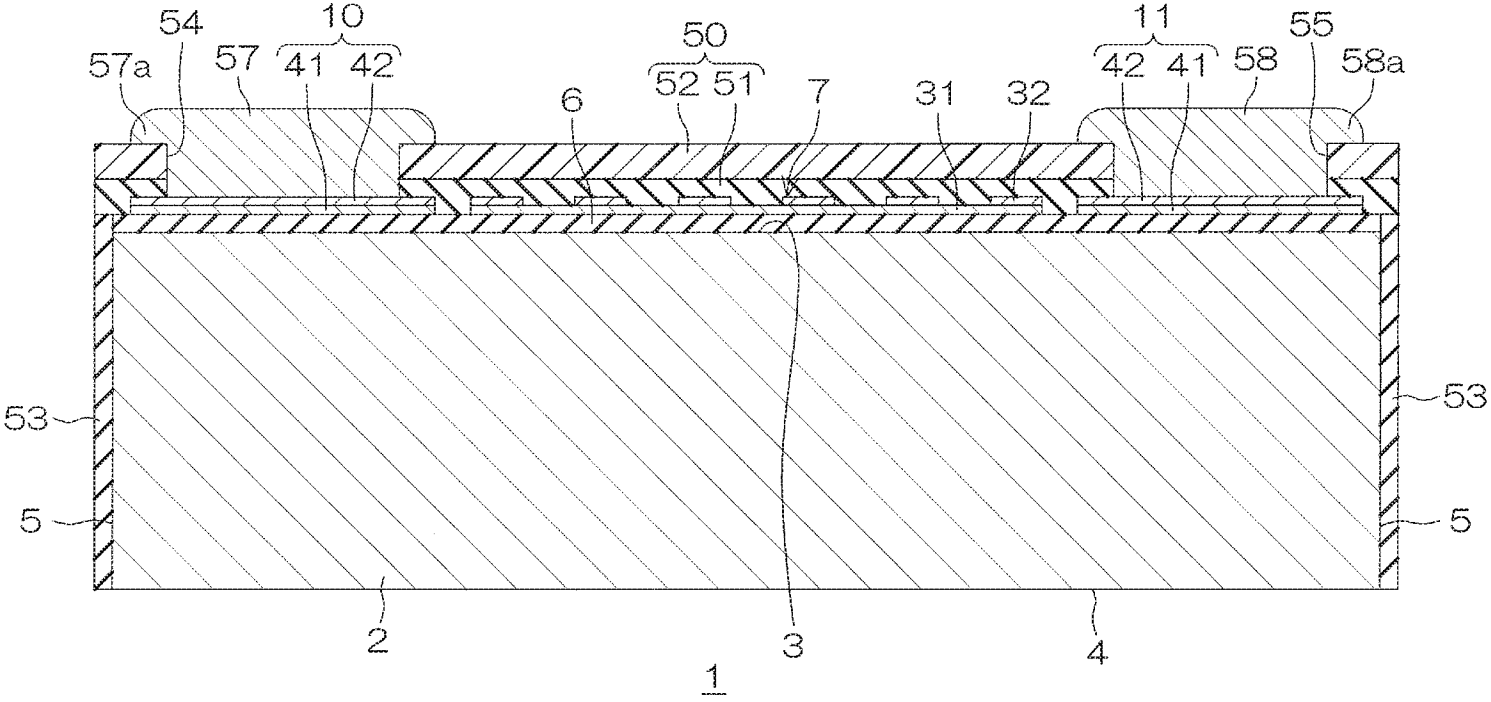
FIG. 3 is a cross-sectional view taken along the line shown in FIG. 2.

FIG. 1 is a partially cutaway perspective view of a chip resistor 1 according to a first preferred embodiment of the present invention. FIG. 2 is a plan view schematically illustrating an internal structure of the chip resistor 1 shown in FIG. 1. FIG. 3 is a cross-sectional view taken along the line III-III shown in FIG. 2.

The chip resistor 1 is a composite type chip part having a structure in which a plurality of chip parts (two chip parts in this preferred embodiment) called a chip 0603 (0.6 mm×0.3 mm), a chip 0402 (0.4 mm×0.2 mm), a chip 03015 (0.3 mm×0.15 mm), etc., is integrally formed.

Referring to FIG. 1, the chip resistor 1 includes a substrate 2 having a parallelopiped shape. The substrate 2 includes a first main surface 3, a second main surface 4 located on an opposite side of the first main surface 3, and a lateral surface 5 connecting the first main surface 3 and the second main surface 4. The first main surface 3 is formed in a rectangular shape in plan view as viewed along a normal direction of the first main surface 3 (hereinafter simply referred to as a "plan view").

Referring to FIG. 2, a length $W_1$ of a first side 2*a* along a first direction of the substrate 2 is, for example, 0.32 mm or more and 0.64 mm or less. A length $W_2$ of a second side 2*b* along a second direction of the substrate 2 is, for example, 0.3 mm or more and 0.6 mm or less.

The first direction is a direction along any lateral surface 5 in the lateral surfaces of the substrate 2. The second direction is a direction intersecting to the first direction (more specifically orthogonally intersecting to the first direction). The first direction is a direction along the lateral surface 5 extending along a vertical direction in FIG. 2, and the second direction is a direction along the lateral surface 5 extending along a horizontal direction in FIG. 2, in this preferred embodiment.

Referring to FIG. 3, a surface insulating film 6 is formed on the first main surface 3 of the substrate 2. The surface insulating film 6 is in contact with the first main surface 3. The surface insulating film 6 covers a whole region of the first main surface 3 of the substrate 2. The surface insulating film 6 may include an $SiO_2$ film or an SiN film.

Referring to FIG. 2 and FIG. 3, a plurality of resistance circuits (two resistance circuits in this preferred embodiment) is formed on the surface insulating film 6. A common internal electrode film 10, a first internal electrode film 11, and a second internal electrode film 12 are further formed on the surface insulating film 6.

The plurality of resistance circuits includes a first resistance circuit 7 and a second resistance circuit 8 that are formed apart from each other along the first direction, in this preferred embodiment. Referring to FIG. 2, a boundary region 9 is formed in a region between the first resistance circuit 7 and the second resistance circuit 8. The first resistance circuit 7 has one end portion and the other end portion. The second resistance circuit 8 has one end portion and the other end portion.

The common internal electrode film 10 is electrically and commonly connected to the one end portion of the first resistance circuit 7 and the one end portion of the second resistance circuit 8. The common internal electrode film 10 is formed along a first side 2*a* of the substrate 2 (first side 2*a* at the left side in FIG. 2). The common internal electrode film 10 is formed in a rectangular shape in plan view.

The common internal electrode film 10 is formed so as to extend at a region between the lateral surface 5 of the substrate 2 and the first resistance circuit 7, and a region between the lateral surface 5 of the substrate 2 and the second resistance circuit 8. The common internal electrode film 10 thereby faces the first resistance circuit 7 and the second resistance circuit 8 along the second direction. The common internal electrode film 10 faces a whole region of the first resistance circuit 7 and a whole region of the second resistance circuit 8 along the second direction, in this preferred embodiment.

The first internal electrode film 11 is connected to the other end portion of the first resistance circuit 7 and is electrically insulated from the second resistance circuit 8. The first internal electrode film 11 is formed at an opposite side of the common internal electrode film 10 across the first resistance circuit 7 on the surface insulating film 6. The first internal electrode film 11 is formed in a region defined by the first resistance circuit 7, the lateral surface 5 of the substrate 2, and the boundary region 9. The first internal electrode film 11 is formed in a rectangular shape in plan view.

The second internal electrode film 12 is connected to the other end portion of the second resistance circuit 8, and is electrically insulated from the first resistance circuit 7. The second internal electrode film 12 is formed at an opposite side of the common internal electrode film 10 across the second resistance circuit 8 on the surface insulating film 6. The second internal electrode film 12 is formed in a region defined by the second resistance circuit 8, the lateral surface 5 of the substrate 2, and the boundary region 9. The second internal electrode film 12 is formed in a rectangular shape in plan view.

A width D along the first direction of the boundary region 9 is, for example, 0.02 mm or more and 0.04 mm or less.

A dummy resistance circuit 15 is formed in the boundary region 9 so as to be in an electrically floating state. That is, the dummy resistance circuit 15 is electrically insulated from the first resistance circuit 7, the second resistance circuit 8, the common internal electrode film 10, the first internal electrode film 11, and the second internal electrode film 12.

Figure 4A:
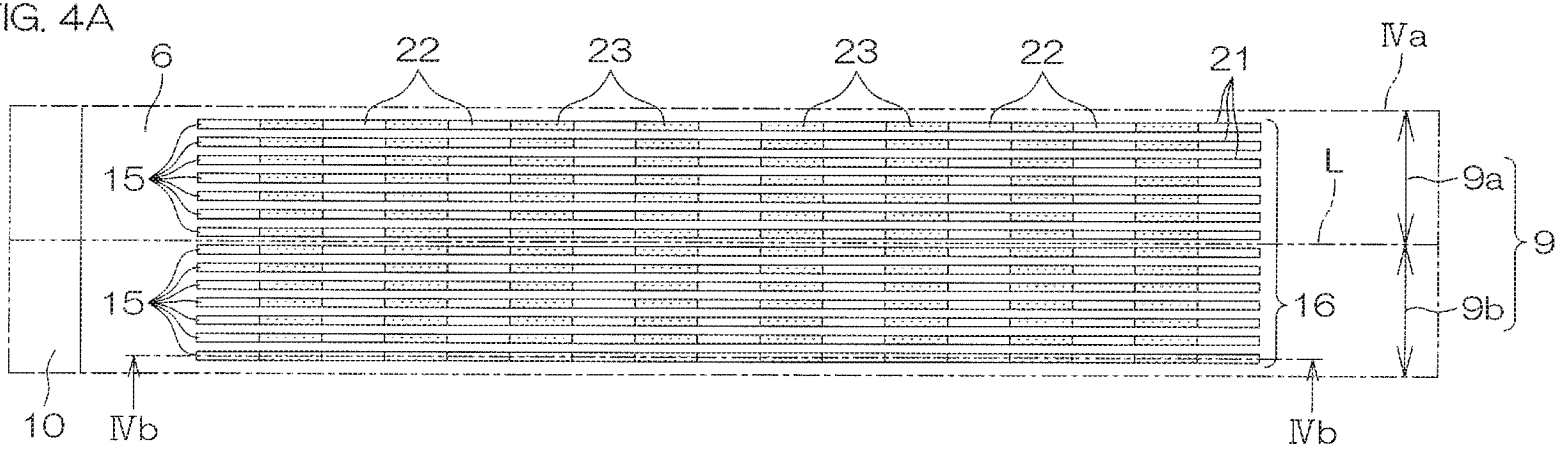
FIG. 4A is an enlarged view of a region IVa shown in FIG. 2.
Figure 4B:
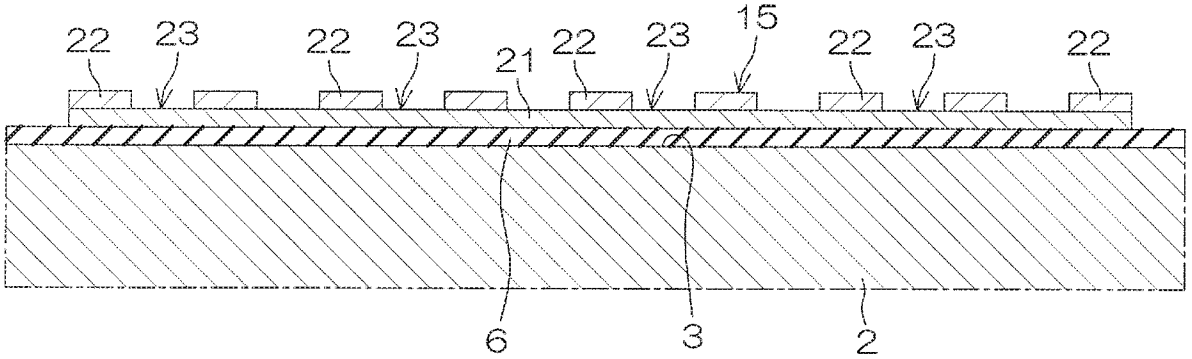
FIG. 4B is a cross-sectional view taken along the line IVb-IVb shown in FIG. 4A.
Figure 5A:
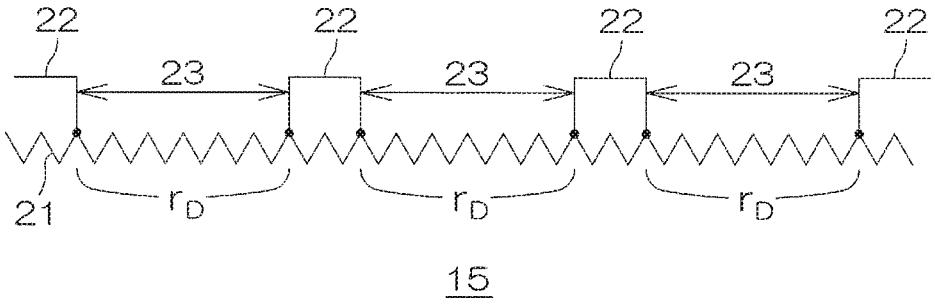
FIG. 5A is an electric circuit diagram for illustrating an electrical structure of a dummy resistance circuit shown in FIG. 4A.
Figure 5B:
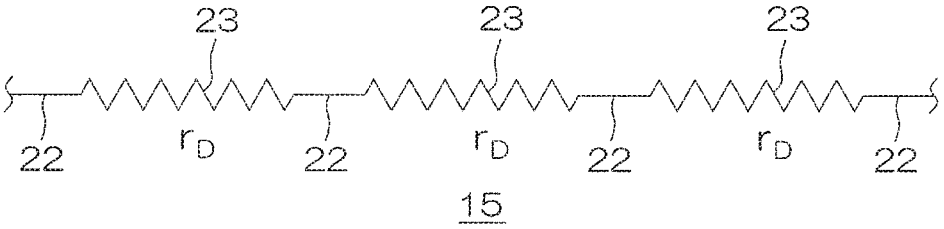
FIG. 5B is an electric circuit diagram for illustrating the electrical structure of a dummy resistance circuit shown in FIG. 4A.

FIG. 4A is an enlarged view of a region IVa shown in FIG. 2. FIG. 4B is a cross-sectional view taken along the line IVb-IVb shown in FIG. 4A. FIG. 5A and FIG. 5B are electric circuit diagrams for illustrating the electrical structure of the dummy resistance circuit shown in FIG. 4A.

A case where the dummy resistance circuit 15 is not included in the chip resistor 1 shall now be considered. In this case, the first resistance circuit 7 and the second resistance circuit 8 arranged close to each other are electrically and/or magnetically affected each other.

As a result, an electric effect and/or a magnetic effect (hereinafter referred to merely as an "electromagnetic interaction") can be occurred between the first resistance circuit 7 and the second resistance circuit 8. In a case where the electromagnetic interaction takes place between the first resistance circuit 7 and the second resistance circuit 8, the resistance value of the first resistance circuit 7 and/or the resistance value of the second resistance circuit 8 can be fluctuated.

An electric field and/or a magnetic field occurred from the first resistance circuit 7, and/or an electric field and/or a magnetic field occurred from the second resistance circuit 8, etc., can be included into the electromagnetic interaction.

The dummy resistance circuit 15 is thus formed in the boundary region 9 between the first resistance circuit 7 and the second resistance circuit 8, in this preferred embodiment. The electromagnetic interaction occurred between the first resistance circuit 7 and the second resistance circuit 8 can thereby be absorbed or shielded by the dummy resistance circuit 15. A fluctuation in resistance value of the first resistance circuit 7 and/or a fluctuation in resistance value of the second resistance circuit 8 can thereby be suppressed.

Referring to FIG. 4A, in this preferred embodiment, a plurality of dummy resistance circuits 15 is formed in the boundary region 9. That is, a single dummy resistance circuit group 16 is formed in the boundary region 9.

The plurality of dummy resistance circuits 15 is arranged at intervals along a facing direction where the first resistance circuit 7 and the second resistance circuit 8 face each other (that is the first direction). The plurality of dummy resistance circuits 15 is formed equidistantly along the first direction.

The plurality of dummy resistance circuits 15 is formed in a linear shape extending along the second direction. That is, the plurality of dummy resistance circuits 15 is formed in a stripe pattern.

The dummy resistance circuit group 16 may include the line-shaped dummy resistance circuits 15 extending along the second direction and the line-shaped dummy resistance circuits 15 extending along the first direction. The line-shaped dummy resistance circuits 15 extending along the first direction may be formed in a region between the line-shaped dummy resistance circuits 15 extending along the second direction adjacent to each other in the first direction. In this case, the line-shaped dummy resistance circuits 15 extending along the first direction may be connected to both the line-shaped dummy resistance circuits 15 extending along the second direction adjacent to each other.

The plurality of dummy resistance circuits 15 is symmetrically formed in the boundary region 9. More specifically, a relation in regard to an arrangement and a shape of the plurality of dummy resistance circuits 15 with respect to the first resistance circuit 7 is substantially equal to a relation in regard to an arrangement and a shape of the plurality of dummy resistance circuits 15 with respect to the second resistance circuit 8.

The boundary region 9 includes a first region 9*a* located at the first resistance circuit 7 side, and a second region 9*b* located at the second resistance circuit 8 side. The first region 9*a* and the second region 9*b* are defined by a dividing line L that evenly divides the boundary region 9 into two portions. The dividing line L is shown by a two-dot chain line in FIG. 4A. The dividing line L extends along the second direction and divides the boundary region 9 into two equal regions along the first direction.

A number of the dummy resistance circuits 15 formed in the first region 9*a* is equal to a number of the dummy resistance circuits 15 formed in the second region 9*b*. Seven dummy resistance circuits 15 are arranged equidistantly in the first region 9*a*, and seven dummy resistance circuits 15 are arranged equidistantly in the second region 9*b*, in this preferred embodiment. The plurality of dummy resistance circuits 15 formed in the first region 9*a* is formed in linear symmetry with respect to the plurality of dummy resistance circuits 15 formed in the second region 9*b* across the dividing line L.

The dummy resistance circuits 15 are formed so as not to overlap onto the dividing line L, in this preferred embodiment. In other preferred embodiments, a single dummy resistance circuit 15 may be formed so as to overlap onto the dividing line L.

In this case, the same number of the dummy resistance circuits 15 may be arranged equidistantly in each of the first region 9*a* and the second region 9*b*. Further in this case, the plurality of dummy resistance circuits 15 arranged in the first region 9*a* and the plurality of dummy resistance circuits 15 arranged in the second region 9*b* may be arranged in linear symmetry with respect to the single dummy resistance circuit 15 that overlaps onto the dividing line L.

A distance between the first resistance circuit 7 and the dummy resistance circuit group 16 is preferably set to be the same value as a distance between the second resistance circuit 8 and the dummy resistance circuit group 16 from the viewpoint of symmetry. The distance between the first resistance circuit 7 and the dummy resistance circuit group 16 is preferably set to be the same value as a distance between the plurality of dummy resistance circuits 15 from the viewpoint of symmetry. Similarly, a distance between the second resistance circuit 8 and the dummy resistance circuit group 16 is preferably set to be the same value as the distance between the plurality of dummy resistance circuits 15 from the viewpoint of symmetry.

Of course, the distance between the first resistance circuit 7 and the dummy resistance circuit group 16 may be larger than the distance between the plurality of dummy resistance circuits 15. Similarly, the distance between the second resistance circuit 8 and the dummy resistance circuit group 16 may be larger than the distance between the plurality of dummy resistance circuits 15.

The dummy resistance circuits 15 have substantially the same structure as the first resistance circuit 7 and the second resistance circuit 8 except that the dummy resistance circuits 15 is formed so as to be in an electrically floating state.

More specifically, referring to FIG. 4B, the plurality of dummy resistance circuits 15 includes a dummy resistance film line 21 formed on the surface insulating film 6, and a plurality of dummy conductor films 22 formed apart from each other on the dummy resistance film line 21, respectively.

The dummy resistance film line 21 is a main body of the dummy resistance circuit 15, and is formed in a linear shape extending along the second direction. The resistivity pi of the dummy resistance film line 21 is larger than the resistivity $\rho_2$ of the dummy conductor films 22 (resistivity $\rho_1$>resistivity $\rho_2$).

The plurality of dummy conductor films 22 is formed on the dummy resistance film line 21 at a prescribed interval such that all of the exposed portions of the dummy resistance film line 21 have the same shape and area in this preferred embodiment. Any portions where the dummy resistance film line 21 and the dummy conductor films 22 are in contact with each other are short-circuited by the dummy conductor films 22.

Referring to FIG. 4B, FIG. 5A and FIG. 5B, the plurality of portions exposed from the plurality of dummy conductor films 22 in each dummy resistance film line 21 forms dummy resistive elements 23, respectively. The plurality of dummy resistive elements 23 has mutually the same shape and area, respectively. Therefore, the plurality of dummy resistive elements 23 has mutually the same resistance value $r_D$.

The plurality of dummy conductor films 22 is arranged in a matrix array at intervals along the first direction and the second direction at the boundary region 9 in plan view, in this preferred embodiment. The plurality of dummy resistive elements 23 is also arranged in a matrix array at intervals along the first direction and the second direction at the boundary region 9 in plan view.

The dummy resistance film line 21 may include at least one of TiN, TiON or TiSiON. The dummy conductor film 22 may include at least one of Al, Cu or AlCu.

A thickness of the dummy resistance film line 21 is, for example, 1000 Å or more and 5000 Å or less (approximately 2000 Å in this preferred embodiment). The dummy conductor film 32 has a thickness greater than the thickness of the dummy resistance film line 21. The thickness of the dummy conductor film 32 is, for example, 5000 Å or more and 10000 Å or less (approximately 8000 Å in this preferred embodiment).

As described above, the plurality of dummy resistance circuits 15 is arranged symmetrically in the boundary region 9, and thus the electromagnetic interaction occurred between the first resistance circuit 7 and the second resistance circuit 8 may be uniformly absorbed or shielded. The structure where the plurality of dummy resistance circuits 15 having substantially the same structure as the structures of the first resistance circuit 7 and the second resistance circuit 8 is formed is effective to improve a uniformity of absorbency and shielding.

The first resistance circuit 7 and the second resistance circuit 8 have substantially the same structure except that The first resistance circuit 7 and the second resistance circuit 8 are arranged in symmetry (linear symmetry) with respect to the boundary region 9. Hereinafter, the structure of the first resistance circuit 7 will be described, taken as an example, and the details relating to the structure of the second resistance circuit 8 will be omitted.

Figure 6:
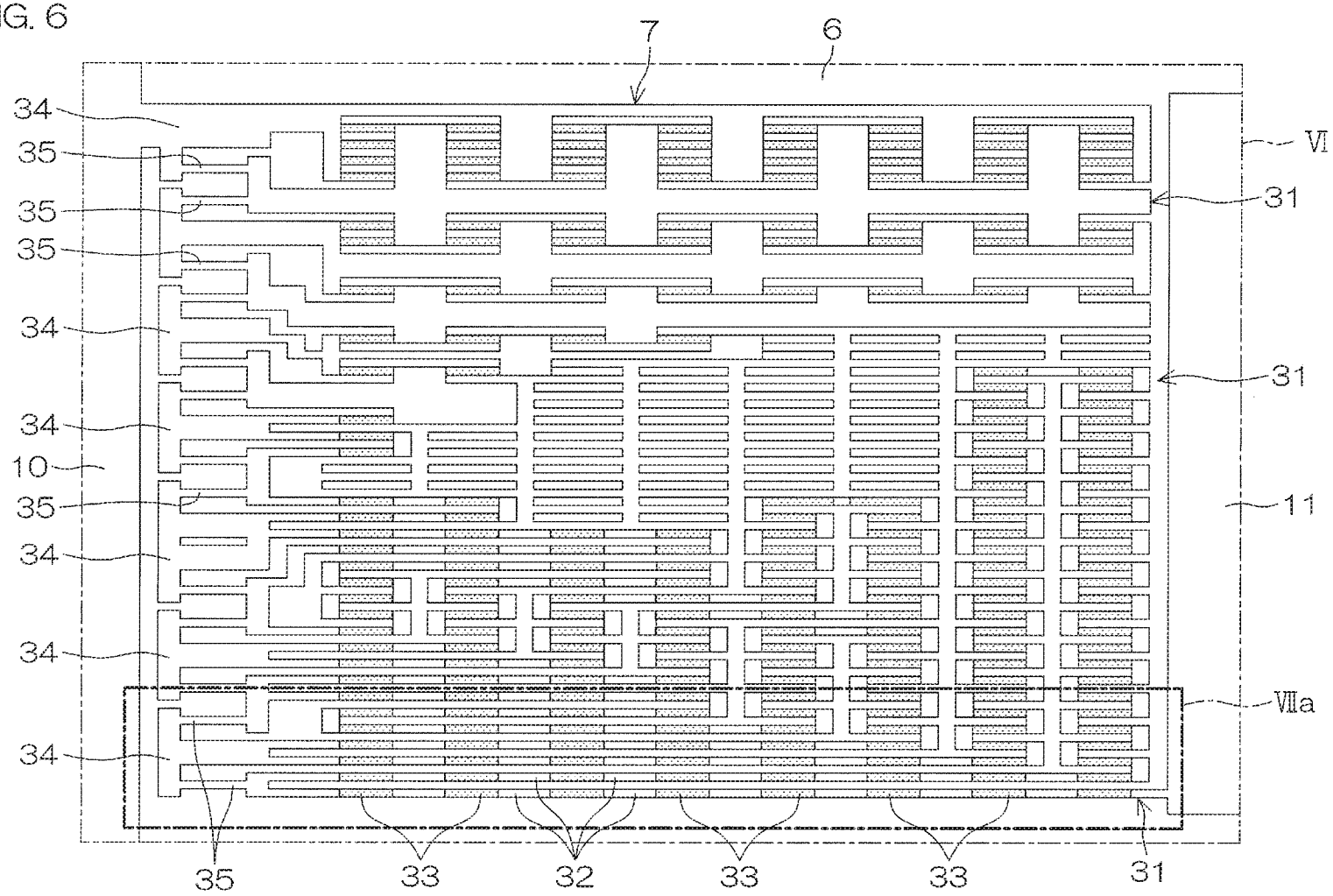
FIG. 6 is an enlarged view of a region VI shown in FIG. 2.
Figure 7A:
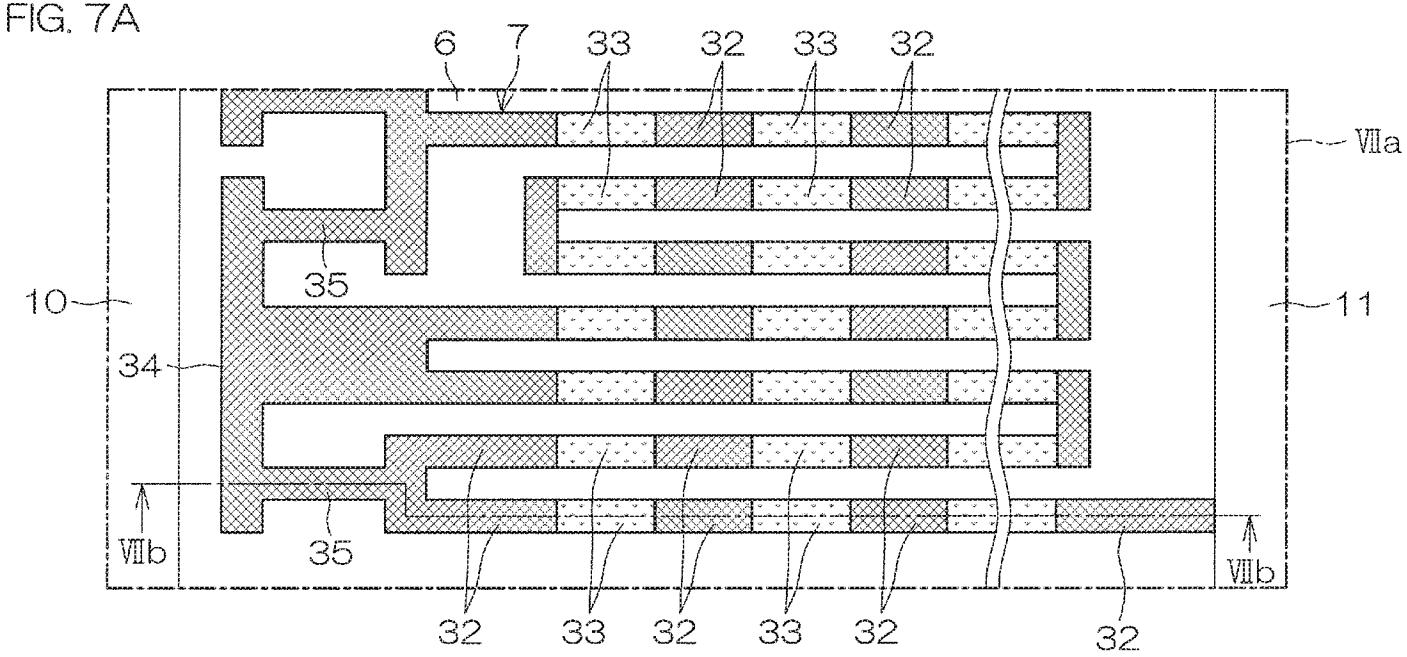
FIG. 7A is a further enlarged view of a region VIIa shown in FIG. 6.
Figure 7B:
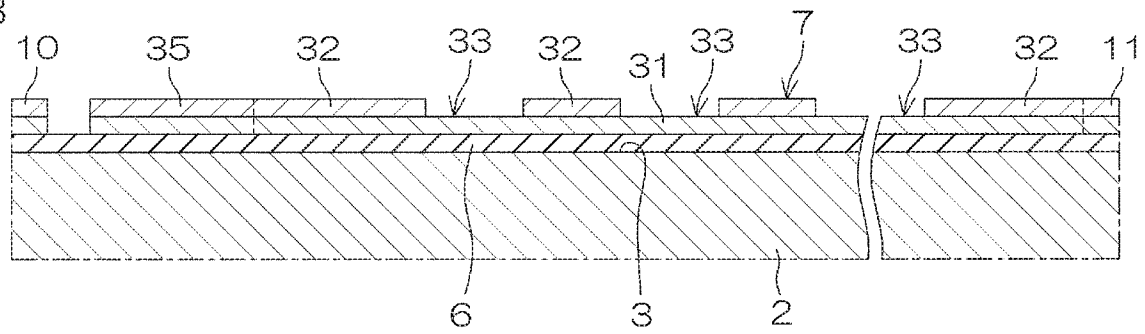
FIG. 7B is a cross-sectional view taken along the line VIIb-VIIb shown in FIG. 7A.
Figure 8A:
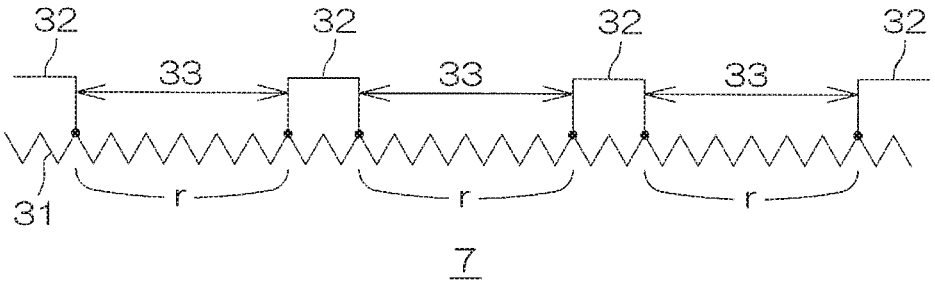
FIG. 8A is an electric circuit diagram for illustrating an electrical structure of a resistor film line and a conductor film shown in FIG. 7A.
Figure 8B:
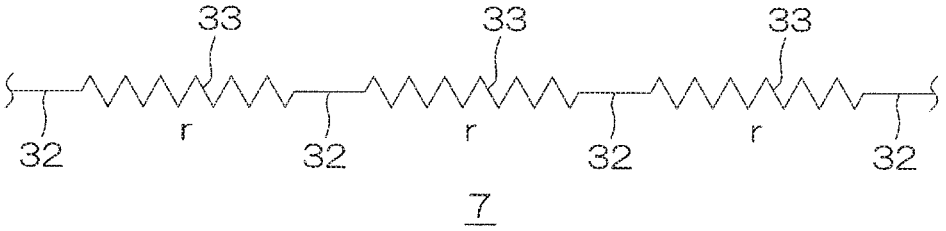
FIG. 8B is an electric circuit diagram for illustrating an electrical structure of a resistor film line and a conductor film shown in FIG. 7A.
Figure 8C:
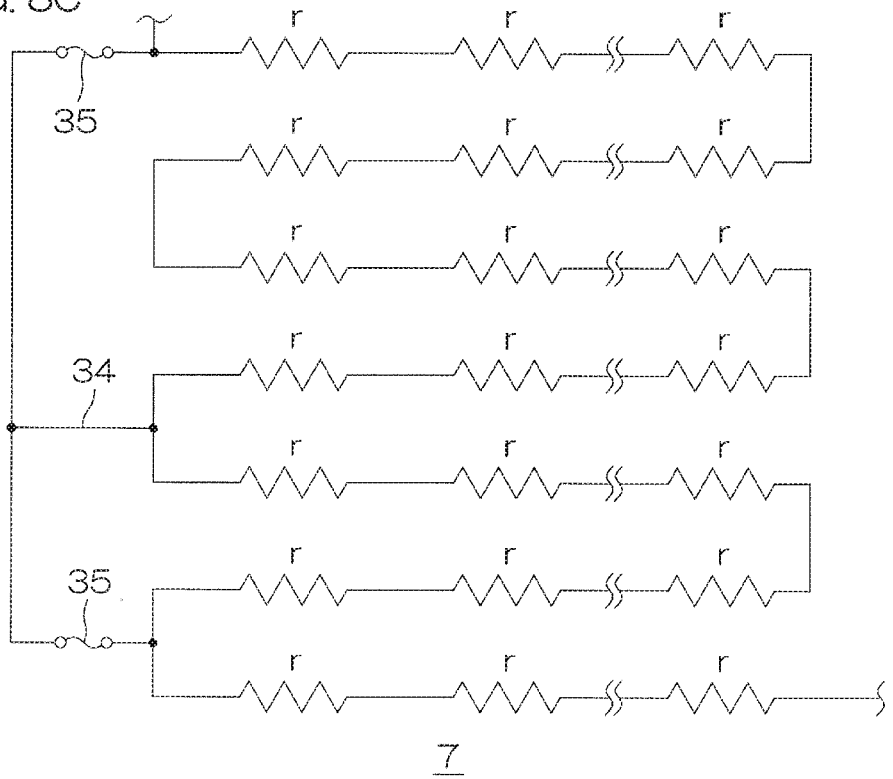
FIG. 8C is an electric circuit diagram for illustrating an electrical structure of a resistor film line and a conductor film shown in FIG. 7A.

FIG. 6 is an enlarged view of a region VI shown in FIG. 2. FIG. 7A is a further enlarged view of a region VIIa shown in FIG. 6. FIG. 7B is a cross-sectional view taken along the line VIIb-VIIb shown in FIG. 7A. FIG. 8A, FIG. 8B and FIG. 8C are electric circuit diagrams for illustrating the electrical structure of a resistor film line 31 (to be described below) and a conductor film 32 shown in FIG. 7A.

Referring to FIG. 6, FIG. 7A and FIG. 7B, the first resistance circuit 7 is formed in a region between the common internal electrode film 10 and the first internal electrode film 11. The first resistance circuit 7 is electrically connected to the common internal electrode film 10 and the first internal electrode film 11.

The first resistance circuit 7 includes a plurality of resistance film lines 31 formed on the surface insulating film 6, and a plurality of conductor films 32 formed at intervals on the plurality of resistance film lines 31. The resistance film lines 31 are made of the same material as a material of the dummy resistance film line 21 and formed in the same thickness as the thickness of the dummy resistance film line 21. The plurality of conductor films 32 is made of the same material as a material of the dummy conductor film 22 and formed in the same thickness as the thickness of the dummy resistance film line 21.

The plurality of resistance film lines 31 may include a linear shaped pattern extending along the second direction. The plurality of resistance film lines 31 may include a linear shaped pattern extending along the first direction. The plurality of resistance film lines 31 may include a pattern formed by selectively combining the linear shaped pattern extending along the second direction and the linear shaped pattern extending along the first direction. The plurality of resistance film lines 31 may include only the line shaped pattern extending along the second direction. The plurality of resistance film lines 31 mainly has a zig-zag pattern in plan view, in this preferred embodiment.

The plurality of conductor films 32 is formed on the resistance film line 31 at a prescribed interval such that all of exposed portions of the resistance film line 31 have the same shape and area. Any portions where the resistance film line 31 and the conductor films 32 are in contact with each other are short-circuited by the conductor films 32.

Referring to FIG. 8A and FIG. 8B, the plurality of portions exposed from the plurality of conductor films 32 in each resistance film line 31 constitutes resistive elements 33, respectively. The plurality of resistive elements 33 has mutually the same shape and area, respectively. Therefore, the plurality of resistive elements 33 has mutually the same resistance value r. The resistance value r of the resistive element 33 may be set to be substantially the same value as the resistance value $r_D$ of the dummy resistive element 23 ($r=r_D$).

The plurality of resistive elements 33 is arranged in a matrix array at intervals along the first direction and the second direction in plan view, in this preferred embodiment. The plurality of resistive elements 33 includes 8 pieces of resistive elements 33 arranged along the second direction and 44 pieces of resistive elements 33 arranged along the first direction, in this preferred embodiment.

A series resistance group is formed in each resistance film line 31 by connecting 1 to 64 pieces of resistive elements 33 in series. Each resistance film line 31 is thereby formed as a unit resistor having a plurality types of resistance values. The resistance value of each resistance film line 31 is determined by a combined resistance of a plurality of resistive elements 33. Further, the resistance value of the first resistance circuit 7 is determined by a combined resistance of a plurality of resistance film lines 31.

The first resistance circuit 7 includes a connection conductor film 34 and a plurality of fuse portions 35.

The connection conductor film 34 is selectively formed in a region between the common internal electrode film 10 and the plurality of resistance film lines 31. The plurality of resistance film lines 31 is electrically and selectively connected to the common internal electrode film 10 via the connection conductor film 34. The plurality of resistance film lines 31 is electrically and selectively connected to each other via the connection conductor film 34.

The plurality of fuse portions 35 is selectively formed in a region between the connection conductor film 34 and the plurality of resistance film lines 31. The plurality of fuse portions 35 is formed in a linear shape extending along the second direction.

The first resistance circuit 7 may be formed such that the plurality of resistance film lines 31 is electrically connected to the common internal electrode film 10 and the first internal electrode film 11 by selectively cutting the plurality of fuse portions 35.

The first resistance circuit 7 may be formed such that the plurality of resistance film lines 31 is electrically insulated from the common internal electrode film 10 and the first internal electrode film 11 by selectively cutting the plurality of fuse portions 35. The fuse portion 35 may be cut (fused) by, for example, a laser irradiation method.

The connection conductor film 34 and the fuse portion 35 may have a laminate structure including the resistance film line 31 and the conductor film 32. The connection conductor film 34 and the fuse portion 35 may have a single layer structure including only the resistance film line 31. The connection conductor film 34 and the fuse portion 35 may have a single layer structure including only the conductor film 32.

The portion shown in FIG. 7A is electrically expressed by an electric diagram shown in FIG. 8C. Referring to FIG. 8C, when the fuse portion 35 is connected, the resistive element 33 (resistor film line 31) is short-circuited by the conductor film 32 and the connection conductor film 34.

Therefore, when a voltage is applied between the common internal electrode film 10 and the first internal electrode film 11, a current flowing through the connection conductor film 34 flows into the connection conductor film 34 and the conductor film 32 by bypassing the resistance film line 31 and the resistive element 33, and thus the resistance value does not increase.

On the other hand, in a case where the fuse portion 35 is cut, a current path is formed such that the current flows into the resistive element 33 (resistance film line 31). Therefore, when a voltage is applied between the common internal electrode film 10 and the first internal electrode film 11, the resistive element 33 is electrically connected to the common internal electrode film 10 and the first internal electrode film 11, and the resistance value is thereby increased.

Figure 9:
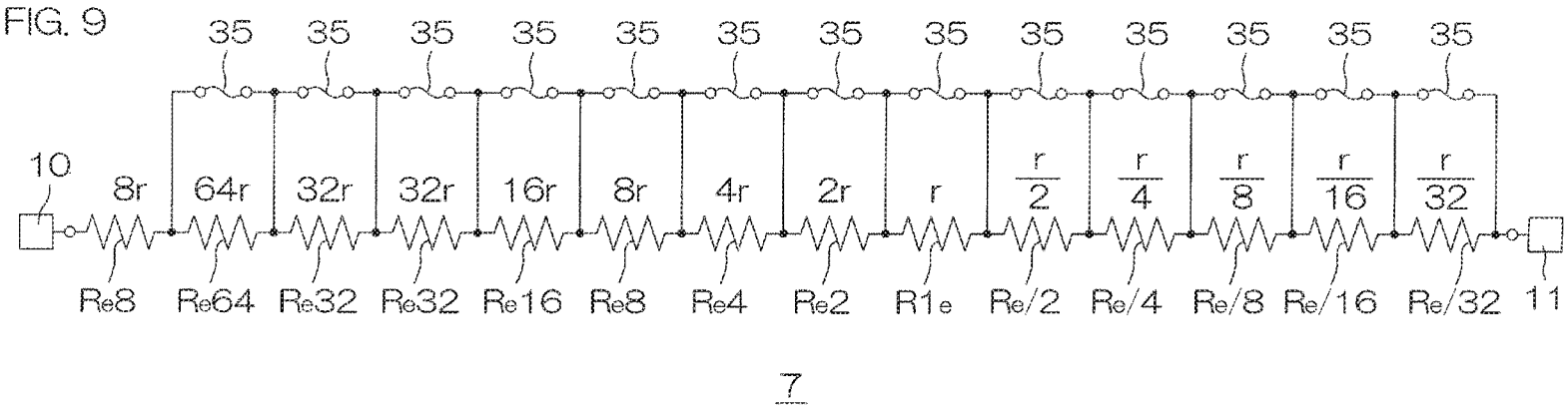
FIG. 9 is an electric circuit diagram illustrating a first example of the electrical structure of a first resistance circuit.

FIG. 9 is an electric circuit diagram illustrating a first example of the electrical structure of the first resistance circuit 7.

Referring to FIG. 9, the first resistance circuit 7 is electrically connected to the common internal electrode film 10 and the first internal electrode film 11. The first resistance circuit 7 has a structure in which a plurality of resistance elements $R_e$ is connected in series. The "resistance elements $R_e$" represents a resistance component formed by a single resistance film line 31 (hereinafter, the same holds true for FIG. 10 and FIG. 11).

The plurality of resistance elements $R_e$ includes a basis resistance element $R_e8$, a resistance element $R_e64$, two resistance elements $R_e32$, a resistance element $R_e16$, a resistance element $R_e8$, a resistance element $R_e4$, a resistance element $R_e2$, a resistance element $R_e1$, a resistance element $R_e/2$, a resistance element $R_e/4$, a resistance element $R_e/8$ a resistance element $R_e/16$, and a resistance element $R_e/32$.

The basis resistance element $R_e8$ and the resistance elements $R_e64$ to $R_e2$ include the same number of resistive elements 33 connected in series as each number of itself shown at the end ("64" for $R_e64$). For example, the resistance element $R_e64$ includes 64 resistive elements 33 connected in series.

The resistance elements $R_e/2$ to $R_e32$ include the same number of resistive elements 33 connected in parallel as each number of itself shown at the end ("32" for $R_e/32$). For example, the resistance element $R_e/32$ includes 32 resistive elements 33 connected in parallel.

The plurality of fuse portions 35 is connected in parallel to the resistance elements $R_e64$ to $R_e/32$ respectively except for the basis resistance element $R_e8$.

In a state where all the fuse portions 35 are not cut, the resistance elements $R_e64$ to $R_e/32$ except for the basis resistance element $R_e8$ are short-circuited by the fuse portions 35. The first resistance circuit 7 can be regarded as including only the basis resistance element $R_e8$. In this case, provided that the resistance value r of one resistive element 33 is 8Ω, a combined resistance value of 64Ω can be obtained.

When a fuse portion 35 is cut, the resistance element $R_e$ corresponding to the cut fuse portion 35 is electrically connected between the common internal electrode film and the first internal electrode film 11.

As described above, the resistance value of the first resistance circuit 7 can be adjusted to become any resistance value by selectively cutting the fuse portions 35. A desired resistance value (combined resistance value) can thus be obtained. The first resistance circuit 7 that has a wide range of resistance values from 1Ω to 10 MΩ can be realized by, for example, adjusting the resistance value r of the resistive element 33.

Figure 10:
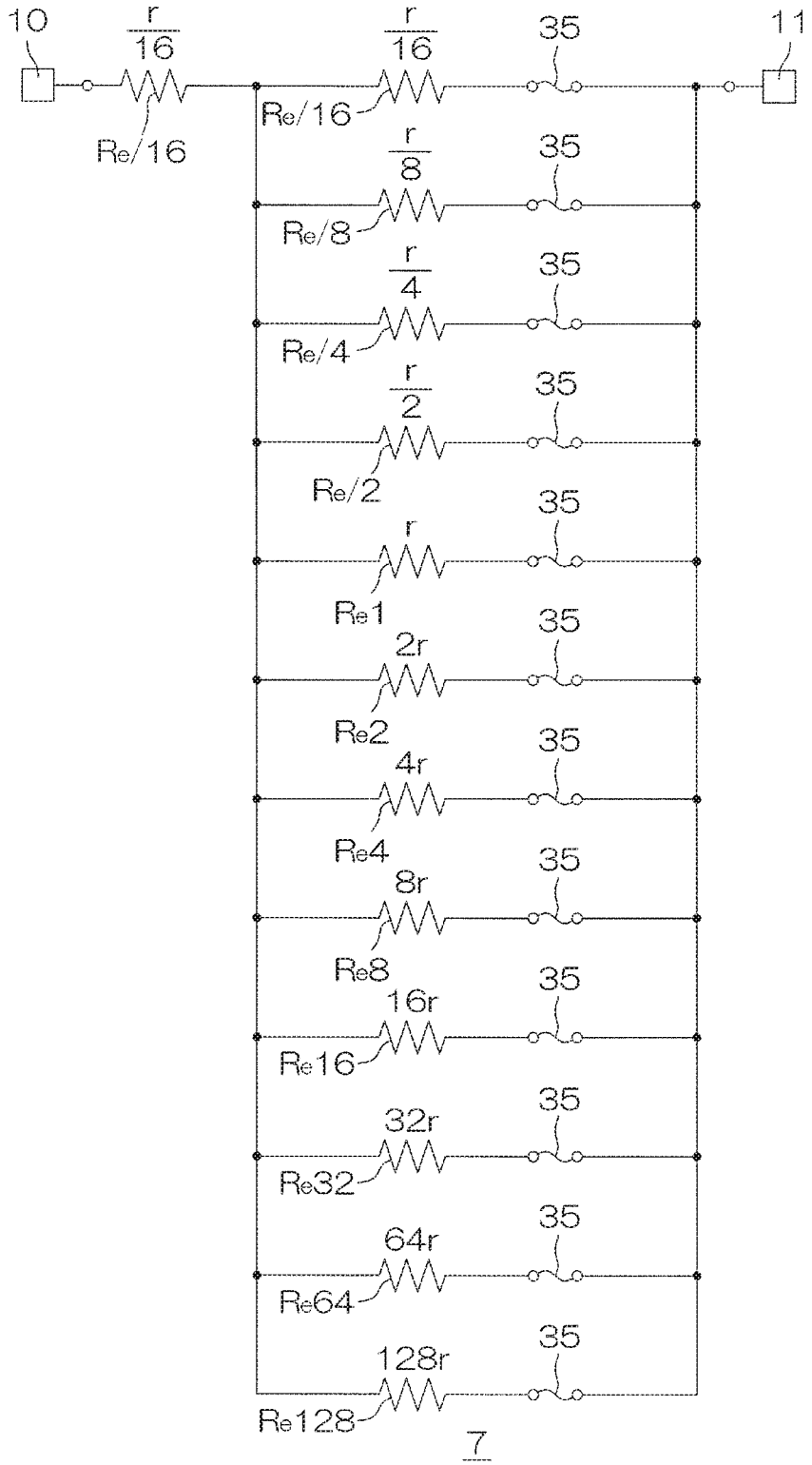
FIG. 10 is an electric circuit diagram illustrating a second example of the electrical structure of a first resistance circuit.

FIG. 10 is an electric circuit diagram illustrating a second example of the electrical structure of the first resistance circuit 7.

Referring to FIG. 10, the first resistance circuit includes a serial circuit in which a parallel circuit including 12 types of resistance elements, including a resistance element $R_e/16$, a resistance element $R_e/8$, a resistance element $R_e/4$, a resistance element $R_e/2$, a resistance element $R_e1$, a resistance element $R_e2$, a resistance element $R_e4$, a resistance element $R_e8$, a resistance element $R_e16$, a resistance element $R_e32$, a resistance element $R_e64$, and a resistance element $R_e128$, is connected to a basis resistance element $R_e/16$ in series.

The plurality of fuse portions 35 is connected in series to the 12 types of resistance elements $R_e/16$ to $R_e128$ respectively except for the basis resistance element $R_e/16$.

According to this circuit configuration, the first resistance circuit 7 having any resistance value can also be formed by selectively cutting the fuse portions 35 as in the case shown in FIG. 9.

Figure 11:
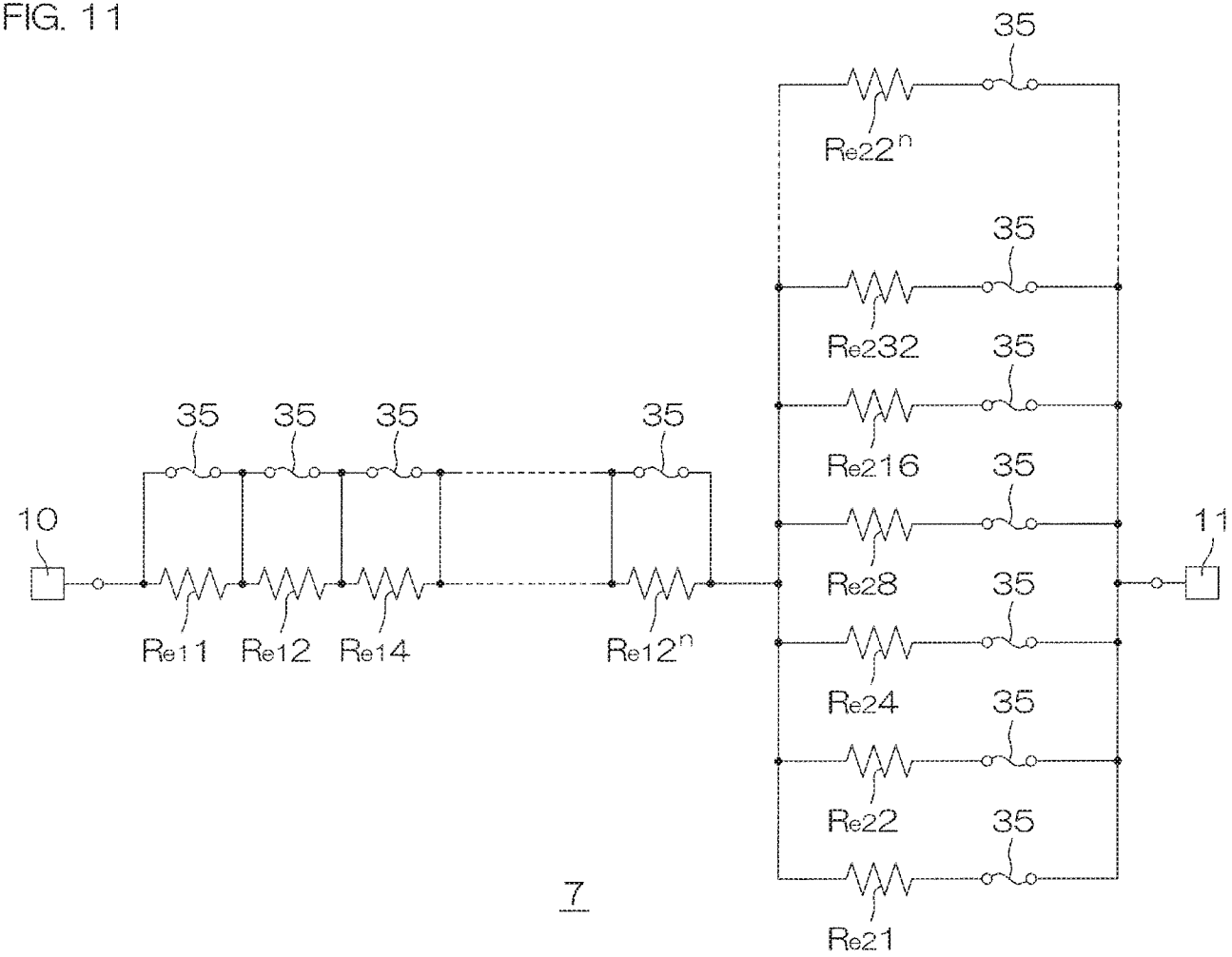
FIG. 11 is an electric circuit diagram illustrating a third example of the electrical structure of a first resistance circuit.

FIG. 11 is an electric circuit diagram illustrating a third example of the electrical structure of the first resistance circuit 7.

Referring to FIG. 11, the first resistance circuit 7 has a structure in which a serial circuit having a plurality of resistance elements $R_{e1}2^n$ (n=0, 1, 2 . . . ) connected in series and a parallel circuit having a plurality of resistance elements $R_{e2}2^n$ (n=0, 1, 2 . . . ) connected in parallel are connected in series with each other.

In the serial circuit, the plurality of fuse portions 35 is connected in parallel to resistor circuits of the resistance elements $R_{e1}2^n$ respectively. In the parallel circuit, the plurality of fuse portions 35 is connected in series to resistor circuits of the resistance elements $R_{e2}2^n$ respectively.

According to this circuit configuration, the first resistance circuit 7 having any resistance value can be formed by selectively cutting the fuse portion 35 as in the case shown in FIG. 9. A high resistance value (for example resistance value greater than or equal to 1 KΩ) can be formed by the serial circuit, and a low resistance value (for example resistance value lower than 1 KΩ) can be formed by the parallel circuit.

Referring to FIG. 3, the common internal electrode film 10, the first internal electrode film 11, and the second internal electrode film 12 have a laminate structure that includes a first conductor film 41 and a second conductor film 42.

The first conductor film 41 is formed on the surface insulating film 6. The second conductor film 42 is formed on the first conductor film 41. The first conductor film 41 is made of the same material as the material of the resistance film line 31 and formed in the same thickness as the thickness of the resistance film line 31. The second conductor film 42 is made of the same material as the material of the conductor film 32 and formed in the same thickness as the thickness of the conductor film 32.

An insulating layer 50 is formed on the surface insulating film 6. The insulating layer 50 covers substantially a whole region of the surface insulating film 6. A lateral wall insulating film 53 is formed on the lateral surface 5 of the substrate 2. A lateral wall insulating film 53 covers substantially a whole region of the lateral surface 5 of the substrate 2.

The insulating layer 50 includes a passivation film 51 and a resin film 52 laminated in this order from the surface insulating film 6. The passivation film 51 includes $SiO_2$ or SiN. The resin film 52 includes polyimide.

The insulating layer 50 has a common pad opening 54 selectively exposing the common internal electrode film 10, a first pad opening 55 selectively exposing the first internal electrode film 11, and a second pad opening 56 selectively exposing the second internal electrode film 12. The common pad opening 54 exposes a central region of the common internal electrode film 10 in the longitudinal direction, in this preferred embodiment.

A common external electrode 57 to be externally connected to is formed in the common pad opening 54. The common external electrode 57 is electrically connected to the common internal electrode film 10 in the common pad opening 54. The common external electrode 57 is electrically connected to the first resistance circuit 7 and the second resistance circuit 8 via the common internal electrode film 10. The common external electrode 57 protrudes from the insulating layer 50. The common external electrode 57 has a covering portion 57*a* (see also FIG. 1) for covering the insulating layer 50.

A first external electrode 58 to be externally connected to is formed in the first pad opening 55. The first external electrode 58 is electrically connected to the first internal electrode film 11 in the first pad opening 55. The first external electrode 58 is electrically connected to the first resistance circuit 7 via the first internal electrode film 11. The first external electrode 58 protrudes from the insulating layer 50. The first external electrode 58 has a covering portion 58*a* for covering the insulating layer 50 (see also FIG. 1).

A second external electrode 59 to be externally connected to is formed in the second pad opening 56. The second external electrode 59 is electrically connected to the second internal electrode film 12 in the second pad opening 56. The second external electrode 59 is electrically connected to the second resistance circuit 8 via the second internal electrode film 12. The second external electrode 59 protrudes from the insulating layer 50. The second external electrode 59 has a covering portion 59*a* for covering the insulating layer 50 (see also FIG. 1).

The common external electrode 57, the first external electrode 58, and the second external electrode 59 may include an Ni/Pd/Au laminate film respectively that includes an Ni film, a Pd film, and an Au film laminated in this order from the substrate 2 side.

Referring to FIG. 1 and FIG. 2, the chip resistor 1 has a notched portion 60 at any corner that connects the lateral surface 5 extending along the first direction and the lateral surface 5 extending along the second direction. The notched portion 60 includes a C chamfer plane 61 at the corner, in this preferred embodiment.

The notched portion 60 is formed at one corner located at the common external electrode 57 side. The notched portion 60 may be formed at two corners located at the common external electrode 57 side. Referring to FIG. 2, the common internal electrode film 10 may include an inclined portion 10*a* inclined along the notched portion 60.

The chip resistor 1 has an asymmetrical appearance due to the notched portion 60. The arrangement of a specific external electrode (for example common external electrode 57) can thereby be recognized on the basis of the appearance of the chip resistor 1. The handling convenience of the chip resistor 1 can thereby be improved.

The notched portion 60 may be formed at the corner located at the first external electrode 58 side and/or at the corner located at the second external electrode 59 side in the substrate 2, instead of the common external electrode 57 side.

The notched portion 60 including a recessed portion recessed toward an inner region of the substrate 2 may be formed at any region of the lateral surface 5 of the substrate 2, instead of the notched portion 60 including the chamfer plane 61. The chip resistor 1 having an asymmetrical appearance can thus be provided by employing such a structure.

Figure 12:
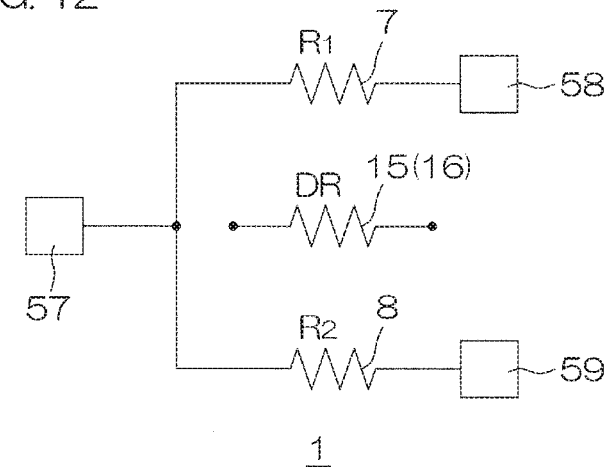
FIG. 12 is an equivalent circuit diagram of the chip resistor shown in FIG. 1.

FIG. 12 is an equivalent circuit diagram of the chip resistor 1 shown in FIG. 1.

Here, the resistance value (value of combined resistance) of the first resistance circuit 7 is defined as $R_1$, the resistance value (value of combined resistance) of the second resistance circuit 8 is defined as $R_2$, and the resistance value (value of combined resistance) of each dummy resistance circuit 15 is defined as DR.

Referring to FIG. 12, the first resistance circuit is electrically connected between the common external electrode 57 and the first external electrode 58. The second resistance circuit 8 is electrically connected between the common external electrode 57 and the second external electrode 59. The dummy resistance circuit 15 is not electrically connected to any of the common external electrode 57, the first external electrode 58 and the second external electrode 59. The common external electrode 57 may be used as a ground terminal.

Both the resistance value $R_1$ of the first resistance circuit 7 and the resistance value $R_2$ of the second resistance circuit 8 can be values within a wide range of values from 1Ω or more to 10 MΩ or less as described above. The resistance value $R_1$ of the first resistance circuit 7 and the resistance value $R_2$ of the second resistance circuit 8 may be set to an equal value ($R_1=R_2$). The resistance value $R_1$ of the first resistance circuit 7 and the resistance value $R_2$ of the second resistance circuit 8 may be set to different values ($R_1 \neq R_2$).

A case where a first chip resistor and a second chip resistor are mounted onto a mounting board shall now be considered. The first chip resistor has a structure where only the first resistance circuit 7 is formed on the first main surface 3 of the substrate 2. The second chip resistor has a structure where only the second resistance circuit 8 is formed on the first main surface 3 of the substrate 2.

In this case, the first chip resistor and the second chip resistor are needed to be mounted onto the mounting board at interval from each other for ensuring safety and insulation. The occupation areas of the first chip resistor and the second chip resistor with respect to the mounting board are thereby increased.

In contrast, according to the chip resistor 1, the first resistance circuit 7 and the second resistance circuit 8 are formed on the first main surface 3 of the common substrate 2. The composite type chip resistor 1 including the first resistance circuit 7 and the second resistance circuit 8 can thereby be provided. According to the composite type chip resistor 1, the first resistance circuit 7 and the second resistance circuit 8 can be formed in a minute pattern corresponding to a layout of a mask used in a manufacturing process of the chip resistor.

Accordingly, miniaturization and approximation of the first resistance circuit 7 and the second resistance circuit 8 can thus be realized without being limited by a wiring rule of the mounting board. The chip resistor 1 capable of suppressing an increase in the occupation area with respect to the mounting board can thereby be provided.

Further, according to the chip resistor 1, the dummy resistance circuit 15 being in an electrically floating state is formed in the boundary region 9 between the first resistance circuit 7 and the second resistance circuit 8 on the first main surface 3 of the substrate 2. The dummy resistance circuit 15 can absorb or shield the electromagnetic interaction occurred between the first resistance circuit 7 and the second resistance circuit 8. The fluctuation in the resistance values between the first resistance circuit 7 and the second resistance circuit 8 can thereby be suppressed.

Particularly, according to the chip resistor 1, the plurality of dummy resistance circuits 15 is arranged symmetrically in the boundary region 9. Also, the plurality of dummy resistance circuits 15 has substantially the same structure as the structures of the first resistance circuit 7 and the second resistance circuit 8. The electromagnetic interaction occurred between the first resistance circuit 7 and the second resistance circuit 8 can thus be absorbed or shielded uniformly by such a structure. The fluctuation in the resistance values between the first resistance circuit 7 and the second resistance circuit 8 can thereby be effectively suppressed.

Further, according to the chip resistor 1, the dummy resistance circuits 15 have substantially the same structure as the structures of the first resistance circuit 7 and the second resistance circuit 8. The dummy resistance circuits 15 can thus be formed through the same formation steps as the formation steps of the first resistance circuit 7 and the second resistance circuit 8 in a manufacturing process of the chip resistor. That is, the dummy resistance circuits 15 can be formed using the same mask as the mask of the first resistance circuit 7 and the second resistance circuit 8. An increase in the number of processing steps due to the addition of the dummy resistance circuit 15 can thereby be prevented in a manufacturing process of the chip resistor.

Also, according to the dummy resistance circuits 15 having such a structure, the symmetry of the dummy resistance circuits 15 with respect to the first resistance circuit 7 and the second resistance circuit 8 can be improved. According to this structure, the absorption effect and/or the shielding effect of the dummy resistance circuits 15 with respect to the electromagnetic interaction can be enhanced.

Also, according to the chip resistor 1 of this preferred embodiment, the common external electrode 57 is electrically connected to the longitudinal central region of the common internal electrode film 10. The common external electrode 57 is electrically connected to the first resistance circuit 7 and the second resistance circuit 8 via the common internal electrode film 10.

A wiring distance from the common external electrode 57 to the first resistance circuit 7, and a wiring distance from the common external electrode 57 to the second resistance circuit 8 can thus be set to equal each other. Occurrence of variations between the wiring distance from the common external electrode 57 to the first resistance circuit 7 and the wiring distance from the common external electrode 57 to the second resistance circuit 8 can thereby be suppressed.

An increase in a wiring impedance (characteristic impedance) between the external electrode 57 and the first resistance circuit 7 can thereby be suppressed. Also, an increase in a wiring impedance (characteristic impedance) between the external electrode 57 and the first resistance circuit 7 can thereby be suppressed. The chip resistor 1 capable of minimizing noises can thus be provided.

Figure 13:
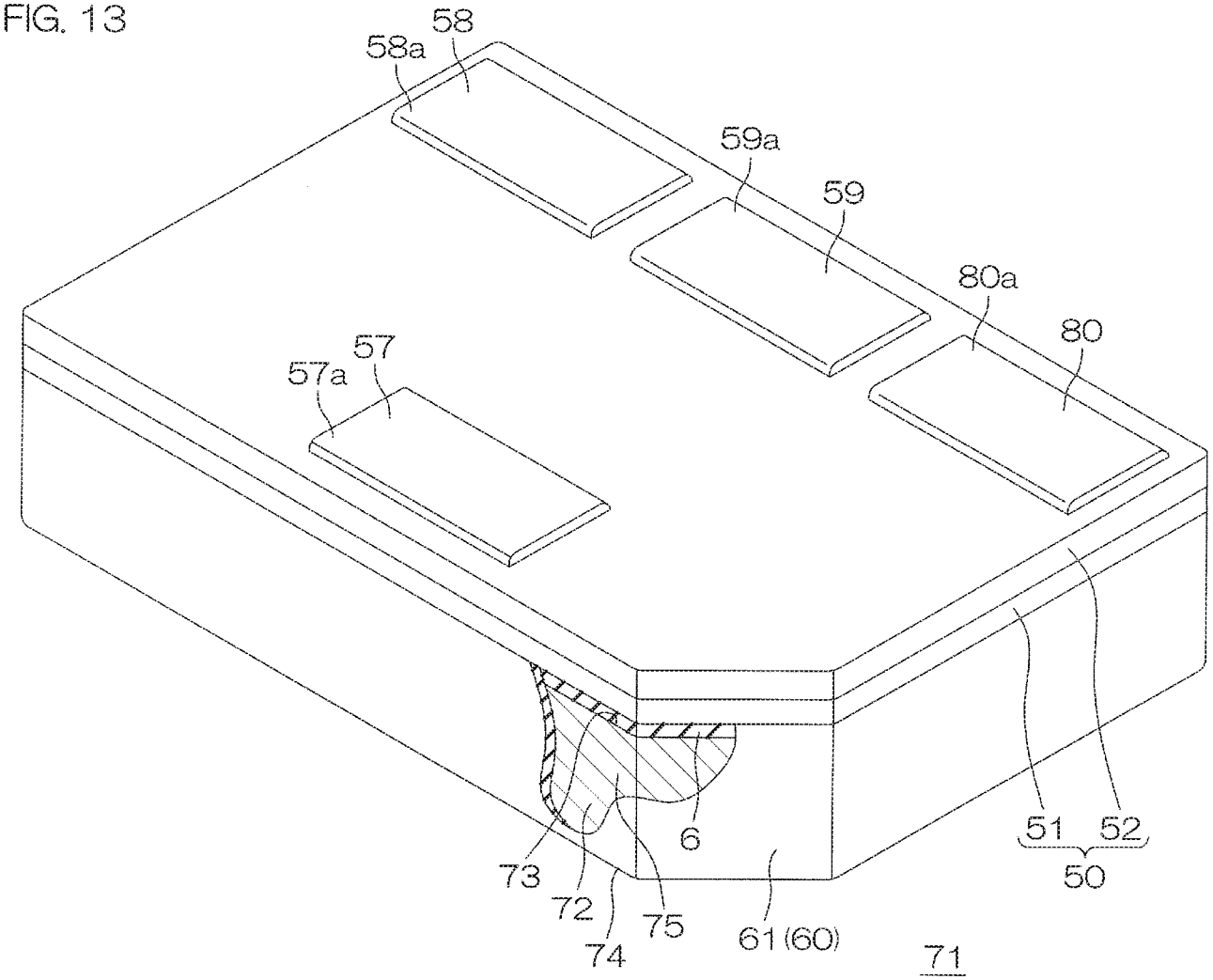
FIG. 13 is a partially cutaway perspective view of a chip resistor according to a second preferred embodiment of the present invention.
Figure 14:
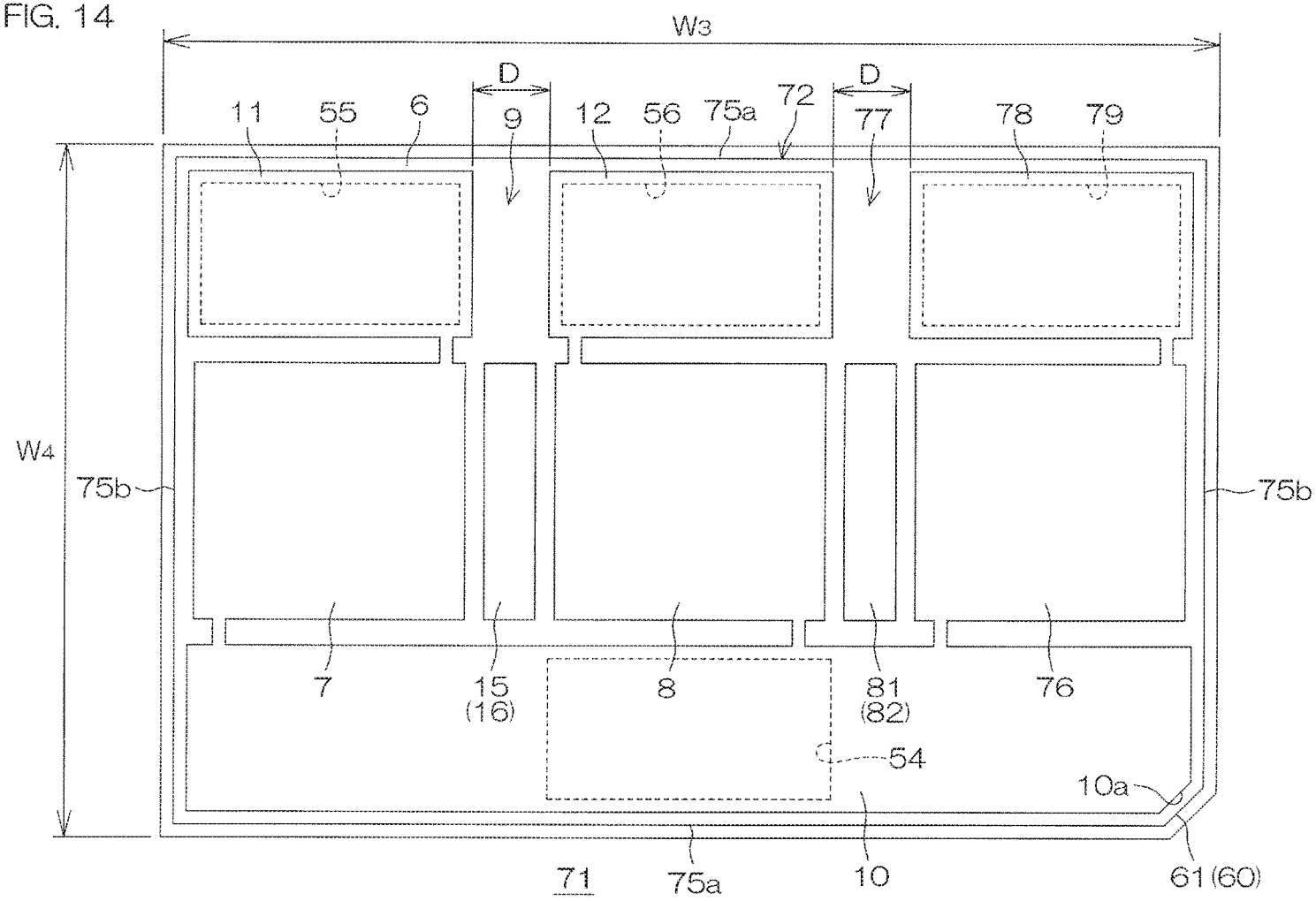
FIG. 14 is a plan view schematically illustrating an internal structure of the chip resistor shown in FIG. 13.

FIG. 13 is a partially cutaway perspective view of a chip resistor 71 according to a second preferred embodiment of the present invention. FIG. 14 is a plan view schematically illustrating an internal structure of the chip resistor 71 shown in FIG. 13. In FIG. 13 and FIG. 14, the same reference numerals are applied to the same structures as the structures described in the first preferred embodiment, and the description will be omitted.

The chip resistor 71 is a composite type chip part having a structure in which a plurality of chip parts (three chip parts in this preferred embodiment) called a chip 0603 (0.6 mm×0.3 mm), a chip 0402 (0.4 mm×0.2 mm), a chip 03015 (0.3 mm×0.15 mm), etc., is integrally formed.

Referring to FIG. 13 and FIG. 14, the chip resistor 71 includes a substrate 72 having a parallelopiped shape. The substrate 72 includes a first main surface 73, a second main surface 74 located on an opposite side of the first main surface 73, and a lateral surface 75 connecting the first main surface 73 and the second main surface 74. The first main surface 73 is formed in a rectangular shape in plan view as viewed along a normal direction of the first main surface 73 (hereinafter simply referred to as a "plan view").

Hereinafter, the lateral surface 75 along a longitudinal direction of the substrate 72 may be called a longitudinal lateral surface 75*a*, and the lateral surface 75 along a transverse direction orthogonal to the longitudinal direction of the substrate 72 may be called a transverse lateral surface 75*b*. A longitudinal length W3 of the substrate 72 is, for example, 0.45 mm or more and 1.0 mm or less. A transverse length W4 of the substrate 72 is, for example, 0.3 mm or more and 0.6 mm or less.

The surface insulating film 6 is formed on the first main surface 73 of the substrate 72. The first resistance circuit 7, the second resistance circuit 8, and a third resistance circuit 76 are formed on the surface insulating film 6 apart from along the longitudinal direction of the substrate 72. The second resistance circuit 8 is interposed between the first resistance circuit 7 and the third resistance circuit 76.

The first resistance circuit 7 and the second resistance circuit 8 are arranged symmetrically (linear symmetry) across the boundary region 9. The second resistance circuit 8 and the third resistance circuit 76 are arranged symmetrically (linear symmetry) across a second boundary region 77. The second boundary region 77 has a width D equal to the width D of the boundary region 9 in regard to the longitudinal direction of the substrate 72.

A third internal electrode film 78 is formed on the surface insulating film 6 in addition to the common internal electrode film 10, the first internal electrode film 11, and the second internal electrode film 12.

The common internal electrode film 10 is commonly and electrically connected to the one end portion of the first resistance circuit 7, the one end portion of the second resistance circuit 8, and one end portion of the third resistance circuit 76. The common internal electrode film 10 is formed along one longitudinal lateral surface 75*a* of the substrate 72 (longitudinal lateral surface 75*a* at a lower side of FIG. 14).

The common internal electrode film 10 is formed so as to extend in a region between the longitudinal lateral surface 75*a* of the substrate 72 and the first resistance circuit 7, in a region between the longitudinal lateral surface 75*a* of the substrate 72 and the second resistance circuit 8, and in a region between the longitudinal lateral surface 75*a* of the substrate 72 and the third resistance circuit 76.

The common internal electrode film 10 thus faces to the first resistance circuit 7, the second resistance circuit 8, and the third resistance circuit 76 along the transverse direction of the substrate 72. The common internal electrode film 10 faces to a whole region of the first resistance circuit 7, a whole region of the second resistance circuit 8, and a whole region of the third resistance circuit 76 along the transverse direction of the substrate 72, in this preferred embodiment.

The first internal electrode film 11 is connected to the other end portion of the first resistance circuit 7, and electrically insulated from the second resistance circuit 8 and the third resistance circuit 76. The first internal electrode film 11 is formed at an opposite side of the common internal electrode film 10 across the first resistance circuit 7 on the surface insulating film 6. The first internal electrode film 11 is formed in a region defined by the first resistance circuit 7, the lateral surface 75 of the substrate 72, and the boundary region 9. The first internal electrode film 11 is formed in a rectangular shape in plan view.

The second internal electrode film 12 is connected to the other end portion of the second resistance circuit 8, and electrically insulated from the first resistance circuit 7 and the third resistance circuit 76. The second internal electrode film 12 is formed at an opposite side of the common internal electrode film 10 across the second resistance circuit 8 on the surface insulating film 6. The second internal electrode film 12 is formed in a region defined by the second resistance circuit 8, the lateral surface 75 of the substrate 72, the boundary region 9, and the second boundary region 77. The second internal electrode film 12 is formed in a rectangular shape in plan view.

The third internal electrode film 78 is connected to the other end portion of the third resistance circuit 76, and electrically insulated from the first resistance circuit 7 and the second resistance circuit 8. The third internal electrode film 78 is formed at an opposite side of the common internal electrode film 10 across the third resistance circuit 76 on the surface insulating film 6. The third internal electrode film 78 is formed in a region defined by the third resistance circuit 76, the lateral surface 75 of the substrate 72, and the second boundary region 77. The third internal electrode film 78 is formed in a rectangular shape in plan view.

The insulating layer 50 is formed on the surface insulating film 6. A third pad opening 79 is formed in the insulating layer 50 in addition to the common pad opening 54, the first pad opening 55, and the second pad opening 56.

The third pad opening 79 selectively exposes the third internal electrode film 78. A third external electrode 80 to be externally connected to is formed in the third pad opening 79. The third external electrode 80 is electrically connected to the third internal electrode film 78 in the third pad opening 79.

The third external electrode 80 is thus electrically connected to the third resistance circuit 76 via the third internal electrode film 78. Referring to FIG. 13, the third external electrode 80 protrudes from the insulating layer 50. The third external electrode 80 has a covering portion 80*a* for covering the insulating layer 50. The third external electrode 80 is made of the same conductor material as the conductor material of the common external electrode 57, the first external electrode 58, and the second external electrode 59.

The third resistance circuit 76 has the same structure as the first resistance circuit 7 (see also FIG. 6 to FIG. 11). The description of the specific structure of the third resistance circuit 76 will be omitted.

The dummy resistance circuit 81 (dummy resistance circuit group 82) is formed in the second boundary region 77. The dummy resistance circuit 81 (dummy resistance circuit group 82) has the same structure of the dummy resistance circuit 15 (dummy resistance circuit group 16) (see also FIG. 4A, FIG. 4B, FIG. 5A and FIG. 5B). The description of the specific structure of the dummy resistance circuit 81 (dummy resistance circuit group 82) will be omitted.

Figure 15:
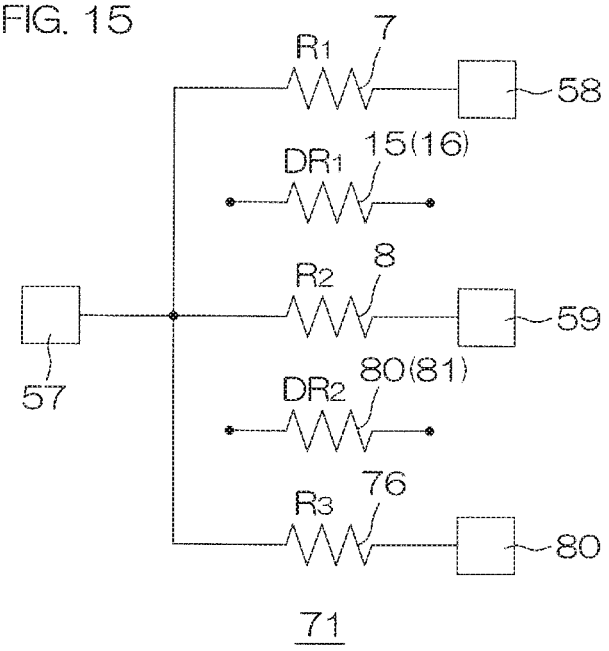
FIG. 15 is an equivalent circuit diagram of the chip resistor shown in FIG. 13.

FIG. 15 is an equivalent circuit diagram of the chip resistor 71 shown in FIG. 13.

Here, the dummy resistance circuit 15 formed in the boundary region 9 is called a "first dummy resistance circuit 15," and the dummy resistance circuit 81 formed in the second boundary region 77 is called a "second dummy resistance circuit 81."

Also, the resistance value (value of combined resistances) of the first resistance circuit 7 is defined as $R_1$, the resistance value (value of combined resistances) of the second resistance circuit 8 is defined as $R_2$, and the resistance value (value of combined resistances) of the third resistance circuit 76 is defined as $R_3$. Also, the resistance value (value of combined resistances) of the first dummy resistance circuit 15 is defined as $DR_1$, and the resistance value (value of combined resistances) of the second dummy resistance circuit 81 is defined as $DR_2$.

Referring to FIG. 15, the first resistance circuit 7 is electrically connected to the common external electrode 57 and the first external electrode 58. The second resistance circuit 8 is electrically connected to the common external electrode 57 and the second external electrode 59.

The third resistance circuit 76 is electrically connected to the common external electrode 57 and the third external electrode 80.

The first dummy resistance circuit 15 is not electrically connected to any of the common external electrode 57, the first external electrode 58, the second external electrode 59, and the third external electrode 80. The second dummy resistance circuit 81 is not electrically connected to any of the common external electrode 57, the first external electrode 58, the second external electrode 59, and the third external electrode 80.

As described above, according to the chip resistor 71 that includes the third resistance circuit 76 in addition to the first resistance circuit 7 and the second resistance circuit 8, the same effect as the effect described in the first preferred embodiment can be achieved.

Although the preferred embodiments of the present invention have been described above, the present invention may also be implemented in yet other modes.

Figure 16:
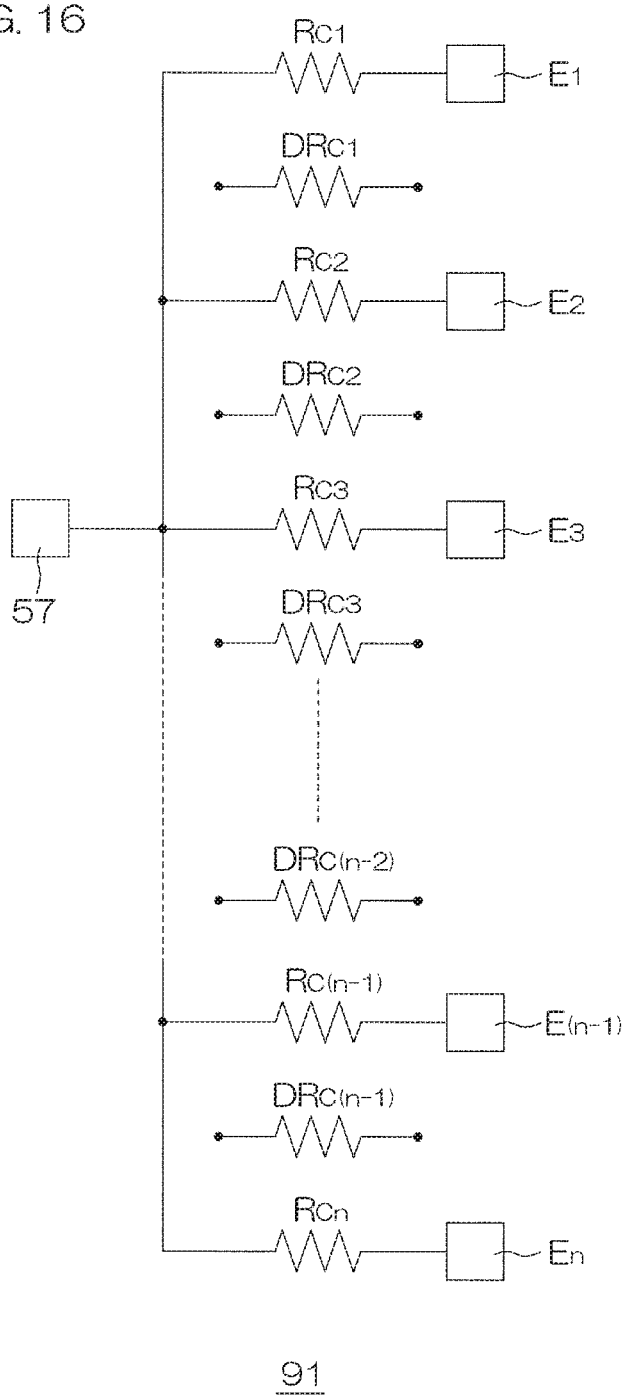
FIG. 16 is an equivalent circuit diagram of a chip resistor according to a first modified example.

For example, a composite type chip resistor 91 represented by an electric circuit diagram shown in FIG. 16 may be employed.

FIG. 16 is an equivalent circuit diagram of the chip resistor 91 according to a first modified example.

Referring to FIG. 16, the chip resistor 91 includes "n" ("n" is a natural number equal to or greater than 2) pieces of external electrodes $E_1$, $E_2$, . . . $E_n$ with respect to one common external electrode 57. Each of resistance circuits $R_{c1}$, $R_{c2}$, . . . $R_{cn}$ is connected between the common external electrode 57 and each external electrode $E_1$, $E_2$, . . . $E_n$.

Dummy resistance circuits $DR_{c1}$, $DR_{c2}$, . . . $DR_{c(n-1)}$ are formed in a region between the resistance circuit $R_{c1}$ and the resistance circuit $R_{c2}$, in a region between the resistance circuit $R_{c2}$ and the resistance circuit $R_{c3}$, . . . in a region between the resistance circuit $R_{c(n-1)}$ and the resistance circuit $R_{cn}$, respectively. A region where the dummy resistance circuit $DR_{c(n-1)}$ is not formed may exist in any region between the resistance circuit $R_{c(n-1)}$ and the resistance circuit $R_{cn}$.

In FIG. 16, when "n" is "2", the chip resistor 1 according to the first preferred embodiment may be obtained. When n is "3", the chip resistor 71 according to the second preferred embodiment may be obtained.

In FIG. 16, when "n" is "4", a chip resistor having a structure in which two chip resistors 1 are integrated in a prescribed manner (integrated into one chip) may be obtained. When n is "5", a chip resistor having a structure in which the chip resistor 1 and the chip resistor 71 are integrated in a prescribed manner (integrated into one chip) may be obtained. When n is "6", a chip resistor having a structure in which two chip resistors 71 are integrated in a prescribed manner (integrated into one chip) may be obtained.

According to the composite type chip resistor 91 such a structure, the same effect as the effect described in the first preferred embodiment can be achieved. Particularly, when "n" is relatively large (for example "n" is equal to or greater than "4"), the occupation area of the chip resistor 91 with respect to the mounting board can be effectively reduced. Also, the "n" pieces of resistance circuits $R_{c1}$, $R_{c2}$, . . . $R_{cn}$ can be mounted onto the mounting board at one step, and the time and effort during mounting can thus be saved.

In each of the preferred embodiments, a structure where the common external electrode 57 (common internal electrode film 10) is commonly and electrically connected to the first resistance circuit 7 and the second resistance circuit 8 is described, in which. However, as shown in FIG. 17, the first resistance circuit 7 and the second resistance circuit 8 are not needed to be commonly connected.

Figure 17:
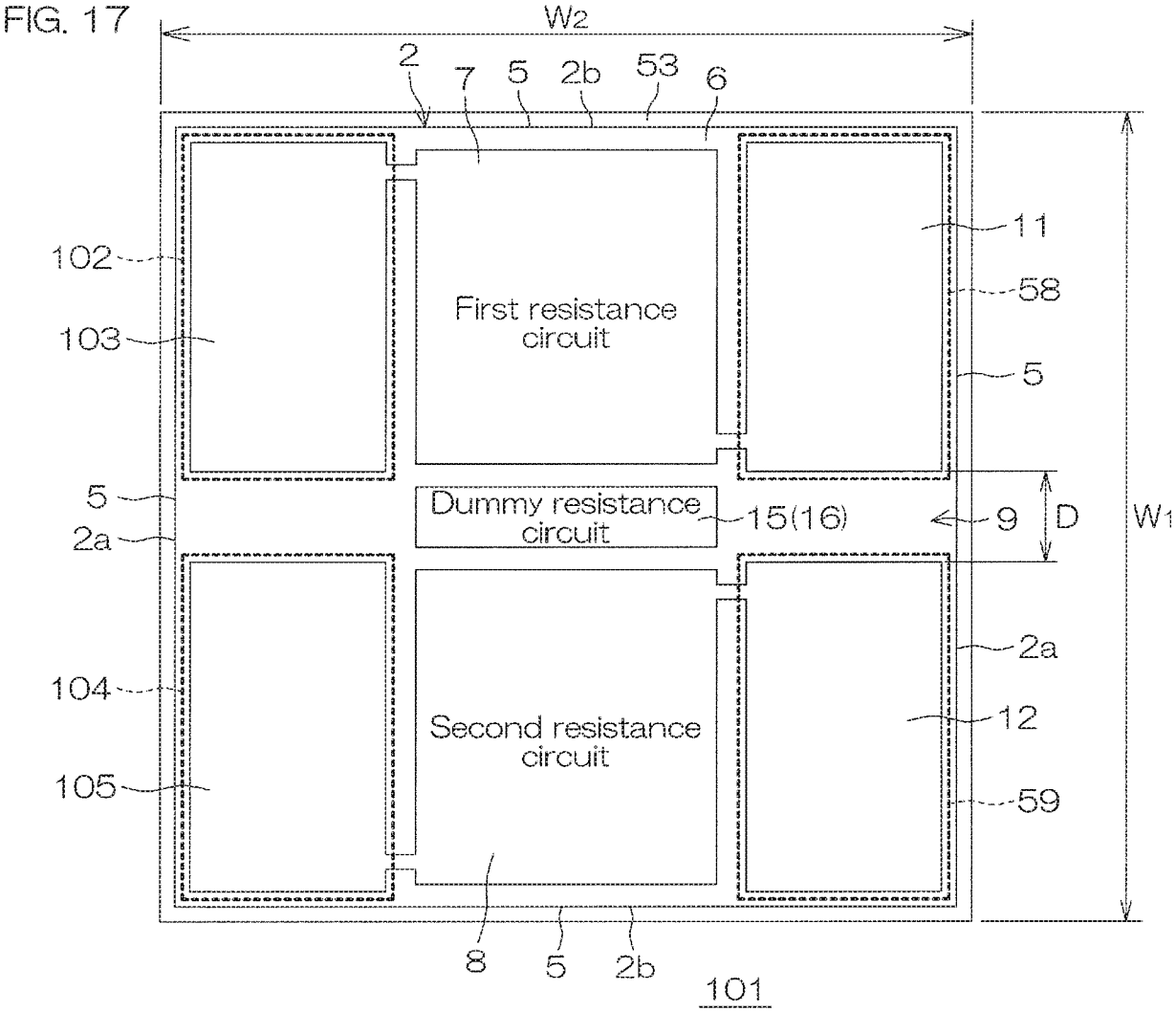
FIG. 17 is a plan view schematically illustrating an internal structure of a chip resistor according to a second modified example.

FIG. 17 is a plan view schematically illustrating an internal structure of a chip resistor 101 according to a second modified example. In FIG. 17, the same reference numerals are applied to the same structures as the structures described in the first preferred embodiment, and the description will be omitted.

The chip resistor 101 includes a third external electrode 102 and a fourth external electrode 104 instead of the common external electrode 57. The chip resistor 101 further includes a third internal electrode film 103 to which the third external electrode 102 is connected and a fourth internal electrode film 105 to which the fourth external electrode 104 is connected.

The third external electrode 102 and the fourth external electrode 104 are formed in substantially the same manner as the manners of the first external electrode 58 and the second external electrode 59. The third internal electrode film 103 and the fourth internal electrode film 105 are formed in substantially the same manner as the manners of the first internal electrode film 11 and the second internal electrode film 12.

The third internal electrode film 103 is connected to the one end portion of the first resistance circuit 7. The third external electrode 102 is connected to the one end portion of the first resistance circuit 7 via the third internal electrode film 103. Therefore, the first resistance circuit 7 is electrically connected to the first external electrode 58 and the third external electrode 102.

In the chip resistor 101, a pair of first external electrodes for the first resistance circuit 7 is formed by the first external electrode 58 and the third external electrode 102. Also, a pair of first internal electrode films for the first resistance circuit 7 is formed by the first internal electrode film 11 and the third internal electrode film 103.

The fourth internal electrode film 105 is connected to the one end portion of the second resistance circuit 8. The fourth external electrode 104 is connected to the one end portion of the second resistance circuit 8 via the fourth internal electrode film 105. The second resistance circuit 8 is thus electrically connected to the second external electrode 59 and the fourth external electrode 104.

In the chip resistor 101, a pair of second external electrodes for the second resistance circuit 8 is formed by the second external electrode 59 and the fourth external electrode 104. Also, a pair of second internal electrode films for the second resistance circuit 8 is formed by the second internal electrode film 12 and the fourth internal electrode film 105.

The structure where one resistance circuit is to be externally connected to in a state of being electrically insulated from the other resistor circuit can also be applied to the second preferred embodiment.

In each of the preferred embodiments, an example where the common external electrode 57 is electrically connected to the central region of the common internal electrode film 10 in the longitudinal direction is described. However, the common external electrode 57 may be electrically connected to one end portion or the other end portion of the end region of the common internal electrode film 10 in the longitudinal direction. That is, the common external electrode 57 may be formed at a region along one corner of the substrate 2, 72. Such a structure can be formed by adjusting the position of the common pad opening 54 exposing the common internal electrode film 10.

In each of the preferred embodiments, the substrates 2, 72 may include a semiconductor substrate (silicon substrate).

In each preferred embodiment, the substrates 2, 72 may include an insulating substrate made of glass ($SiO_2$) or resin (for example epoxy resin). In a case where the substrate 2 is made of the insulating substrate, the surface insulating film 6 and the lateral wall insulating film 53 can be omitted. Further, in a case where the substrate 2 is made of the insulating substrate, the first resistance circuit 7, the second resistance circuit 8, the third resistance circuit 76, etc., may be formed in contact with the first main surface 3.

The chip resistors 1, 71, 91, 101 may be incorporated in a mobile terminal such as an electronic device, a mobile electronic device, etc., for example, as a circuit element for a power supply circuit, a circuit element for a high frequency circuit, and a circuit element for a digital circuit, etc.

This application corresponds to Patent Application No. 2016-082979 submitted to Japanese Patent Office on Apr. 18, 2016, and the entire contents of the application is hereby incorporated by reference.

Although the embodiments according to the present invention have been detailed as above, these embodiments are merely examples to clarify the technical subject matter of the present invention, and thus the present invention should not be limited to these embodiments, and the scope of the present invention, therefore, is to be determined solely by the following claims.

What is claimed is:

1. A chip resistor comprising:

a substrate having a main surface;

a first resistance circuit formed at the main surface of the substrate;

a second resistance circuit formed at the main surface of the substrate apart from the first resistance circuit;

a common internal electrode formed at the main surface of the substrate and electrically connected to the first resistance circuit and the second resistance circuit;

a first internal electrode formed at the main surface of the substrate and electrically connected to the first resistance circuit;

a second internal electrode formed at the main surface of the substrate and electrically connected to the second resistance circuit; and a dummy resistance circuit formed in a region between the first resistance circuit and the second resistance circuit at the main surface of the substrate so as to be in an electrically floating state, wherein the first resistance circuit includes a resistance film formed at the main surface of the substrate, and a plurality of conductor films having a resistivity smaller than a resistivity of the resistance film and formed at an interval on the resistance film so as to selectively expose the resistance film as a resistive element, and the dummy resistance circuit includes a dummy resistance film formed at the main surface of the substrate, and a plurality of dummy conductor films having a resistivity smaller than the resistivity of a dummy resistance film formed at an interval on the dummy resistance film so as to selectively expose the dummy resistance film as a dummy resistive element.

2. The chip resistor according to claim 1, wherein the dummy resistance circuit is configured to absorb an electric effect and/or a magnetic effect occurred between the first resistance circuit and the second resistance circuit.

3. The chip resistor according to claim 1, wherein a plurality of the dummy resistance circuits is formed in the region between the first resistance circuit and the second resistance circuit.

4. The chip resistor according to claim 3, wherein the plurality of dummy resistance circuits is formed in a stripe pattern extending along a same direction.

5. The chip resistor according to claim 3, wherein a relation in regard to an arrangement and a shape of the plurality of dummy resistance circuits with respect to the first resistance circuit is the same as a relation in regard to an arrangement and a shape of the plurality of dummy resistance circuits with respect to the second resistance circuit.

6. The chip resistor according to claim 1, wherein the resistance values of the plurality of the dummy resistive elements are set to a same value.

7. The chip resistor according to claim 1, wherein the resistance values of the plurality of the dummy resistive elements and the resistance values of the plurality of the resistive elements are set to a same value.

8. The chip resistor according to claim 1, wherein the first resistance circuit includes a fuse portion, and the fuse portion connects at least one of the plurality of resistive elements to the common internal electrode and the first internal electrode when the fuse portion is cut out, or the fuse portion electrically insulates at least one of the plurality of resistive elements from the common internal electrode and the first internal electrode when the fuse portion is cut out.

9. The chip resistor according to claim 1 further comprising:

a common external electrode electrically connected to the common internal electrode film;

a first external electrode electrically connected to the first internal electrode; and a second external electrode electrically connected to the second internal electrode.

10. The chip resistor according to claim 1, further comprising:

a third resistance circuit formed at the main surface of the substrate and electrically insulated from the first resistance circuit and the second resistance circuit; and a third internal electrode formed at the main surface of the substrate and electrically connected to the third resistance circuit, wherein the common internal electrode is electrically connected to the third internal electrode in addition to the first resistance circuit and the second resistance circuit.

11. The chip resistor according to claim 10, wherein the third resistance circuit is formed adjacent to the second resistance circuit, and a second dummy resistance circuit is further formed in a region between the second resistance circuit and the third resistance circuit on the main surface of the substrate so as to be in an electrically floating state.

12. The chip resistor according to claim 11, wherein the second dummy resistance circuit is configured to absorb an electric effect and/or a magnetic effect occurred between the second resistance circuit and the third resistant circuit.

* * * * *